US009460724B2

(12) United States Patent
Herre et al.

(10) Patent No.: US 9,460,724 B2
(45) Date of Patent: Oct. 4, 2016

(54) AUDIO SIGNAL DECODER, AUDIO SIGNAL ENCODER, METHOD FOR PROVIDING AN UPMIX SIGNAL REPRESENTATION, METHOD FOR PROVIDING A DOWNMIX SIGNAL REPRESENTATION, COMPUTER PROGRAM AND BITSTREAM USING A COMMON INTER-OBJECT-CORRELATION PARAMETER VALUE

(75) Inventors: Juergen Herre, Buckenhof (DE); Johannes Hilpert, Nuremberg (DE); Andreas Hoelzer, Erlangen (DE); Jonas Engdegard, Stockholm (SE); Heiko Purnhagen, Sundbyberg (SE)

(73) Assignees: Fraunhofer-Gesellschaft zur Foerderung der angewandten Forschung e.V., Munich (DE); Dolby International AB, Amsterdam Zuid-Oost (NL)

( * ) Notice: Subject to any disclaimer, the term of this patent is extended or adjusted under 35 U.S.C. 154(b) by 1112 days.

(21) Appl. No.: 13/434,450

(22) Filed: Mar. 29, 2012

(65) Prior Publication Data

US 2012/0269353 A1 Oct. 25, 2012

Related U.S. Application Data

(63) Continuation of application No. PCT/EP2010/064379, filed on Sep. 28, 2010.

(60) Provisional application No. 61/246,681, filed on Sep. 29, 2009, provisional application No. 61/369,505, filed on Jul. 30, 2010.

(30) Foreign Application Priority Data

Jul. 30, 2010 (EP) ..... 10171406

(51) Int. Cl.

| | |
|---|---|
| ***H04R 5/00*** | (2006.01) |
| ***G10L 19/008*** | (2013.01) |
| ***G10L 19/005*** | (2013.01) |
| ***G10L 19/20*** | (2013.01) |
| *H04S 3/02* | (2006.01) |
| *H04S 5/00* | (2006.01) |

(52) U.S. Cl.

CPC ..... *G10L 19/008* (2013.01); *G10L 19/005* (2013.01); *G10L 19/20* (2013.01); *H04S 3/02* (2013.01); *H04S 5/005* (2013.01); *H04S 2420/03* (2013.01)

(58) Field of Classification Search

CPC ..... G10L 19/008; G10L 19/20; H04S 3/00; H04S 3/02; H04S 5/005; H04S 2420/03

USPC ..... 381/20, 22, 23; 704/500–504

See application file for complete search history.

(56) References Cited

U.S. PATENT DOCUMENTS

| | | | | |
|---|---|---|---|---|
| 6,611,212 | B1 | 8/2003 | Craven et al. | |
| 7,903,824 | B2 | 3/2011 | Faller et al. | |
| 8,538,766 | B2 | 9/2013 | Hellmuth et al. | |
| 8,625,808 | B2 | 1/2014 | Kim et al. | |
| 8,687,829 | B2 | 4/2014 | Hilpert et al. | |
| 8,843,378 | B2 | 9/2014 | Herre et al. | |
| 8,891,797 | B2 * | 11/2014 | Thiergart | G10L 21/0272 381/356 |
| 8,958,566 | B2 * | 2/2015 | Hellmuth | G10L 19/008 381/22 |
| 9,042,559 | B2 | 5/2015 | Oh | |
| 2007/0036228 | A1 | 2/2007 | Tseng | |
| 2007/0043575 | A1 | 2/2007 | Onuma et al. | |
| 2007/0168183 | A1 | 7/2007 | Van De Kerkhof | |
| 2008/0002842 | A1 | 1/2008 | Neusinger et al. | |
| 2009/0192789 | A1 | 7/2009 | Lee et al. | |
| 2010/0094631 | A1 * | 4/2010 | Engdegard | G10L 19/008 704/258 |

FOREIGN PATENT DOCUMENTS

| | | |
|---|---|---|
| CN | 101160618 | 4/2008 |
| JP | 2006-003580 | 1/2006 |
| RU | 2010114875 A | 11/2011 |
| TW | I226041 | 12/2000 |
| TW | I 302664 | 1/2006 |

| | | |
|---|---|---|
| WO | WO-2005-083679 | 9/2005 |
| WO | WO 2006/072270 | 7/2006 |
| WO | WO-2006072270 | 7/2006 |
| WO | WO-2008084427 | 7/2008 |
| WO | WO-2008111773 | 9/2008 |
| WO | WO 2008/150141 | 12/2008 |
| WO | 2009046909 A1 | 4/2009 |

OTHER PUBLICATIONS

"Information technology—MPEG audio technologies—Part 2: Spatial Audio Object Coding (SAOC)", ISO/IEC JTC 1/SC 29 N, ISO/IEC FDIS 23003-2:2010(E), Mar. 10, 2010, 133 pages.

Faller, et al., "Binaural Cue Coding—Part II: Schemes and Applications", IEEE Transactions on Speech and Audio Processing, vol. 11, No. 6, Nov. 2003, pp. 520-531.

Faller, C , "Parametric Joint-Coding of Audio Sources,", 120th AES Convention, New York, NY, U.S.A., May 20, 2006, 12 pages.

Herre, et al., "From SAC to SAOC—Recent Developments in Parametric Coding of Spatial Audio", Illusions in Sound, AES 22nd UK Conference, Apr. 2007, 8 pages.

Holzer, Andreas; "Compact Side Information for Hierarchical Parametric Multi-Channel Audio Coding"; U.S. Appl. No. 60/671,544, filed Apr. 15, 2005; 6 pages.

Engdegard J. et al.: "Spatial Audio Object Coding (SAOC)—The Upcoming MPEG Standard on Parametric Object Based Audio Coding", 124$^{th}$ AES Convention, Audio Engineering Society May 17, 2008, pp. 1-15.

Engdegard, Jonas et al., "Changes for Editorial Consistency of the MPEG SAOC FCD Text", International Organization for Standardization, 90th MPEG Meeting, Xian, Oct. 26, 2009-Oct. 30, 2009., Oct. 23, 2009, 102 pages—document unavailable, but includes European Patent Office, "Result of Consultation of Jul. 29, 2016", Jul. 29, 2016, 3 pages that confirms this reference is equal to reference 2 below.

ISO/IEC FCD, 13003-2:200X, "Spatial Audio Object Coding", 89th MPEG Meeting, London, Motion Picture Expert Group or ISO/IEC JTC1/SC29/WG11, No. N10843, Jul. 4, 2009, 102 pages. This Doc Is Equal to Reference 1—See European Patent Office, "Result of Consultation of Jul. 29, 2016", Jul. 29, 2016, 3 pages.

Purnhagen, Heiko et al., "Technical Provisions for Efficient Operation of the SAOC Codec Using Signals with a High Inter-Object Correlation", International Organization for Standardization Organisation Internationale Normalisation, Oct. 2009, 7 pages.

* cited by examiner

*Primary Examiner* — Xu Mei
(74) *Attorney, Agent, or Firm* — Perkins Coie LLP; Michael A. Glenn

(57) ABSTRACT

An audio signal decoder for providing an upmix signal representation on the basis of a downmix signal representation and an object-related parametric information and in dependence on a rendering information has an object parameter determinator. The object parameter determinator is configured to obtain inter-object-correlation values for a plurality of pairs of audio objects. The object parameter determinator is configured to evaluate a bitstream signaling parameter in order to decide whether to evaluate individual inter-object-correlation bitstream parameter values to obtain inter-object-correlation values for a plurality of pairs of related audio objects, or to obtain inter-object-correlation values for a plurality of pairs of related audio objects using a common inter-object-correlation bitstream parameter value. The audio signal decoder also has a signal processor configured to obtain the upmix signal representation on the basis of the downmix signal representation and using the inter-object-correlation values for a plurality of pairs of related objects and the rendering information.

9 Claims, 10 Drawing Sheets

MPEG SAOC single IOC parameter caculation

Syntax of SAOCSpecificConfig()

| Syntax | No. of bits | Mnemonic |
|---|---|---|
| SAOCSpecificConfig() | | |
| { | | |
| Sampling Frequency Configuration; | | |
| Low Delay Mode Configuration; | | |
| Frequency Resolution Configuration; | | |
| Frame Length Configuration; | | |
| Object Number Configuration: | | |
| bs Num Objects | 5 | uimsbf |
| Object Relationship Configuration: | | |
| for (i=0; i<bsNumObjects+1; i++ ){ | | |
| bsRelatedTo[i][i] = 1; | | |
| for( j=i+1; j<bsNumObjects+1; j++ ){ | | |
| **bsRelatedTo**[i][j]; | 1 | uimsbf |
| bsRelatedTo[j][i] = bsRelatedTo[i][j]; | | |
| } | | |
| } | | |
| Absolute Energy Transmission Configuration; | | |
| Downmix Channel Number Configuration; | | |
| Additional Configuration Information | | |
| Common Inter-Object-Correlation Configuration Information | | |
| bsOneIOC; | 1 | uimsbf |
| Distortion Control Unit Configuration | | |
| ByteAlign(); | | |
| SAOCExtensionConfig(); | | |
| } | | |

FIGURE 5

Syntax of SAOCFrame()

| Syntax | No. of bits | Mnemonic |
|---|---|---|
| SAOCFrame() | | |
| { | | |
| encoded object-level-difference values (OLD) | | |
| (band-wise and per audio object) | | |
| encoded absolute energy values (optional)(NRG) | | |
| (band-wise) | | |
| encoded inter-object correlation values (IOC) | | |
| (band-wise for combinations of audio objects) | | |
| k=0; | | |
| iocIdx1=0; | | |
| iocIdx2=0; | | |
| for( i=0; i<bsNumObjects+1; i++ ) { | | |
| idxIOC[i][i] = 0; | | |
| for( j=i+1; j<bsNumOjects+1; j++ ){ | | |
| if ( bsRelatedTo[i][j] !=0 ){ | | |
| if ( bsOneIOC == 0 ){ | | |
| idxIOC[i][j] = EcDataSaoc(IOC, k , numBands); | | |
| k++; | | |
| } else { | | |
| if ( k == 0 ) | | |
| idxIOC[i][j] = EcDataSaoc(IOC, k, numBands); | | |
| k++; | | 610 |
| iocIdx1=i; | | |
| iocIdx2=j; | | |
| } else { | | |
| idxIOC[i][j] = idxIOC[iocIdx1][iocIdx2]; | | |
| } | | |
| } | | |
| } else { | | |
| idxIOC[i][j] = 5; | | |
| } | | |
| idxIOC[j][i] = idxIOC[i][j]; | | |
| } | | |
| } | | |
| encoded downmix-gain values (DMG) | | |
| (per audio object) | | |
| encoded downmix channel level differences (DCLD) | | |
| (per audio object, optional) | | |
| encoded post-processing downmix gain values (PDG) | | |
| (band-wise and per downmix channel) | | |
| encoded distortion-control-unit parameters | | |
| ByteAlign(); | | |
| SAOCExtensionFrame(); | | |
| } | | |

FIGURE 6

Table 83 - IOC parameter quantization table

| idx | 0 | 1 | 2 | 3 | 4 | 5 | 6 | 7 |
|---|---|---|---|---|---|---|---|---|
| ICC[idx] | 1 | 0.937 | 0.84118 | 0.60092 | 0.36764 | 0 | -0.589 | -0.99 |

710 720

MPEG SAOC system overview

SEPARATE DECODER AND MIXER

INTEGRATED DECODER AND MIXER

AUDIO SIGNAL DECODER, AUDIO SIGNAL ENCODER, METHOD FOR PROVIDING AN UPMIX SIGNAL REPRESENTATION, METHOD FOR PROVIDING A DOWNMIX SIGNAL REPRESENTATION, COMPUTER PROGRAM AND BITSTREAM USING A COMMON INTER-OBJECT-CORRELATION PARAMETER VALUE

CROSS-REFERENCE TO RELATED APPLICATIONS

This application is a continuation of copending International Application No. PCT/EP2010/064379, filed Sep. 28, 2010, which is incorporated herein by reference in its entirety, and additionally claims priority from U.S. Application No. U.S. 61/246,681, filed Sep. 29, 2009, U.S. 61/369,505, filed Jul. 30, 2010 and European Application No. EP 10171406.1, filed Jul. 30, 2010, all of which are incorporated herein by reference in their entirety.

Embodiments according to the invention are related to an audio signal decoder for providing an upmix signal representation on the basis of a downmix signal representation and an object-related parametric information and in dependence on a rendering information.

Other embodiments according to the invention relate to an audio signal encoder for providing a bitstream representation on the basis of a plurality of audio object signals.

Other embodiments according to the invention relate to a method for providing an upmix signal representation on the basis of a downmix signal representation and an object-related parametric information and in dependence on a rendering information.

Other embodiments according to the invention relate to a method for providing a bitstream representation on the basis of a plurality of audio object signals.

Other embodiments according to the invention are related to a computer program for performing said methods.

Other embodiments according to the invention are related to a bitstream representing a multi-channel audio signal.

BACKGROUND OF THE INVENTION

In the art of audio processing, audio transmission and audio storage, there is an increasing desire to handle multi-channel contents in order to improve the hearing impression. Usage of multi-channel audio content brings along significant improvements for the user. For example, a 3-dimensional hearing impression can be obtained, which brings along an improved user satisfaction in entertainment applications. However, multi-channel audio contents are also useful in professional environments, for example in telephone conferencing applications, because the speaker intelligibility can be improved by using a multi-channel audio playback.

However, it is also desirable to have a good tradeoff between audio quality and bitrate requirements in order to avoid an excessive resource load caused by multi-channel applications.

Recently, parametric techniques for the bitrate-efficient transmission and/or storage of audio scenes containing multiple audio objects have been proposed, for example, Binaural Cue Coding (Type I) (see, for example reference [BCC]), Joint Source Coding (see, for example, reference [JSC]), and MPEG Spatial Audio Object Coding (SAOC) (see, for example, references [SAOC1], [SAOC2] and non-prepublished reference [SAOC]).

These techniques aim at perceptually reconstructing the desired output audio scene rather than a waveform match.

FIG. 8 shows a system overview of such a system (here: MPEG SAOC). In addition, FIG. 9*a* shows a system overview of such a system (here: MPEG SAOC).

The MPEG SAOC system 800 shown in FIG. 8 comprises an SAOC encoder 810 and an SAOC decoder 820. The SAOC encoder 810 receives a plurality of object signals $x_1$ to $x_N$, which may be represented, for example, as time-domain signals or as time-frequency-domain signals (for example, in the form of a set of transform coefficients of a Fourier-type transform, or in the form of QMF subband signals). The SAOC encoder 810 typically also receives downmix coefficients $d_1$ to $d_N$, which are associated with the object signals $x_1$ to $x_N$. Separate sets of downmix coefficients may be available for each channel of the downmix signal. The SAOC encoder 810 is typically configured to obtain a channel of the downmix signal by combining the object signals $x_1$ to $x_N$ in accordance with the associated downmix coefficients $d_1$ to $d_N$. Typically, there are less downmix channels than object signals $x_1$ to $x_N$. In order to allow (at least approximately) for a separation (or separate treatment) of the object signals at the side of the SAOC decoder 820, the SAOC encoder 810 provides both the one or more downmix signals (designated as downmix channels) 812 and a side information 814. The side information 814 describes characteristics of the object signals $x_1$ to $x_N$, in order to allow for a decoder-sided object-specific processing.

The SAOC decoder 820 is configured to receive both the one or more downmix signals 812 and the side information 814. Also, the SAOC decoder 820 is typically configured to receive a user interaction information and/or a user control information 822, which describes a desired rendering setup. For example, the user interaction information/user control information 822 may describe a speaker setup and the desired spatial placement of the objects, which provide the object signals $x_1$ to $x_N$.

The SAOC decoder 820 is configured to provide, for example, a plurality of decoded upmix channel signals $\hat{y}_1$ to $\hat{y}_M$. The upmix channel signals may for example be associated with individual speakers of a multi-speaker rendering arrangement. The SAOC decoder 820 may, for example, comprise an object separator 820*a*, which is configured to reconstruct, at least approximately, the object signals $x_1$ to $x_N$ on the basis of the one or more downmix signals 812 and the side information 814, thereby obtaining reconstructed object signals 820*b*. However, the reconstructed object signals 820*b* may deviate somewhat from the original object signals $x_1$ to $x_N$, for example, because the side information 814 is not quite sufficient for a perfect reconstruction due to the bitrate constraints. The SAOC decoder 820 may further comprise a mixer 820*c*, which may be configured to receive the reconstructed object signals 820*b* and the user interaction information/user control information 822, and to provide, on the basis thereof, the upmix channel signals $\hat{y}_1$ to $\hat{y}_M$. The mixer 820 may be configured to use the user interaction information/user control information 822 to determine the contribution of the individual reconstructed object signals 820*b* to the upmix channel signals $\hat{y}_1$ to $\hat{y}_M$. The user interaction information/user control information 822 may, for example, comprise rendering parameters (also designated as rendering coefficients), which determine the contribution of the individual reconstructed object signals 822 to the upmix channel signals $\hat{y}_1$ to $\hat{y}_M$.

However, it should be noted that in many embodiments, the object separation, which is indicated by the object separator 820*a* in FIG. 8, and the mixing, which is indicated by the mixer 820*c* in FIG. 8, are performed in single step. For this purpose, overall parameters may be computed which describe a direct mapping of the one or more downmix signals 812 onto the upmix channel signals $\hat{y}_1$ to $\hat{y}_M$. These parameters may be computed on the basis of the side information and the user interaction information/user control information 820.

Taking reference now to FIGS. 9*a*, 9*b* and 9*c*, different apparatus for obtaining an upmix signal representation on the basis of a downmix signal representation and object-related side information will be described. FIG. 9*a* shows a block schematic diagram of a MPEG SAOC system 900 comprising an SAOC decoder 920. The SAOC decoder 920 comprises, as separate functional blocks, an object decoder 922 and a mixer/renderer 926. The object decoder 922 provides a plurality of reconstructed object signals 924 in dependence on the downmix signal representation (for example, in the form of one or more downmix signals represented in the time domain or in the time-frequency-domain) and object-related side information (for example, in the form of object meta data). The mixer/renderer 924 receives the reconstructed object signals 924 associated with a plurality of N objects and provides, on the basis thereof, one or more upmix channel signals 928. In the SAOC decoder 920, the extraction of the object signals 924 is performed separately from the mixing/rendering, which allows for a separation of the object decoding functionality from the mixing/rendering functionality but brings along a relatively high computational complexity.

Taking reference now to FIG. 9*b*, another MPEG SAOC system 930 will be briefly discussed, which comprises an SAOC decoder 950. The SAOC decoder 950 provides a plurality of upmix channel signals 958 in dependence on a downmix signal representation (for example, in the form of one or more downmix signals) and an object-related side information (for example, in the form of object meta data). The SAOC decoder 950 comprises a combined object decoder and mixer/renderer, which is configured to obtain the upmix channel signals 958 in a joint mixing process without a separation of the object decoding and the mixing/rendering, wherein the parameters for said joint upmix process are dependent both on the object-related side information and the rendering information. The joint upmix process depends also on the downmix information, which is considered to be part of the object-related side information.

To summarize the above, the provision of the upmix channel signals 928, 958 can be performed in a one-step process or a two-step process.

Taking reference now to FIG. 9*c*, an MPEG SAOC system 960 will be described. The SAOC system 960 comprises an SAOC to MPEG Surround transcoder 980, rather than an SAOC decoder.

The SAOC to MPEG Surround transcoder comprises a side information transcoder 982, which is configured to receive the object-related side information (for example, in the form of object meta data) and, optionally, information on the one or more downmix signals and the rendering information. The side information transcoder is also configured to provide an MPEG Surround side information (for example, in the form of an MPEG Surround bitstream) on the basis of a received data. Accordingly, the side information transcoder 982 is configured to transform an object-related (parametric) side information, which is relieved from the object encoder, into a channel-related (parametric) side information, taking into consideration the rendering information and, optionally, the information about the content of the one or more downmix signals.

Optionally, the SAOC to MPEG Surround transcoder 980 may be configured to manipulate the one or more downmix signals, described, for example, by the downmix signal representation, to obtain a manipulated downmix signal representation 988. However, the downmix signal manipulator 986 may be omitted, such that the output downmix signal representation 988 of the SAOC to MPEG Surround transcoder 980 is identical to the input downmix signal representation of the SAOC to MPEG Surround transcoder. The downmix signal manipulator 986 may, for example, be used if the channel-related MPEG Surround side information 984 would not allow to provide a desired hearing impression on the basis of the input downmix signal representation of the SAOC to MPEG Surround transcoder 980, which may be the case in some rendering constellations.

Accordingly, the SAOC to MPEG Surround transcoder 980 provides the downmix signal representation 988 and the MPEG Surround bitstream 984 such that a plurality of upmix channel signals, which represent the audio objects in accordance with the rendering information input to the SAOC to MPEG Surround transcoder 980 can be generated using an MPEG Surround decoder which receives the MPEG Surround bitstream 984 and the downmix signal representation 988.

To summarize the above, different concepts for decoding SAOC-encoded audio signals can be used. In some cases, a SAOC decoder is used, which provides upmix channel signals (for example, upmix channel signals 928, 958) in dependence on the downmix signal representation and the object-related parametric side information. Examples for this concept can be seen in FIGS. 9*a* and 9*b*. Alternatively, the SAOC-encoded audio information may be transcoded to obtain a downmix signal representation (for example, a downmix signal representation 988) and a channel-related side information (for example, the channel-related MPEG Surround bitstream 984), which can be used by an MPEG Surround decoder to provide the desired upmix channel signals.

In the MPEG SAOC system 800, a system overview of which is given in FIG. 8, and also in the MPEG SAOC system 900, a system overview of which is given in FIG. 9, the general processing is carried out in a frequency selective way and can be described as follows within each frequency band:

- N input audio object signals $x_1$ to $x_N$ are downmixed as part of the SAOC encoder processing. For a mono downmix, the downmix coefficients are denoted by $d_1$ to $d_N$. In addition, the SAOC encoder 810, 910 extracts side information 814 describing the characteristics of the input audio objects. An important part of this side information consists of relations of the object powers and correlations with respect to each other, i.e., object-level differences (OLDs) in inter-object-correlations (IOCs).
- Downmix signal (or signals) 812, 912 and side information 814, 914 are transmitted and/or stored. To this end, the downmix audio signal may be compressed using well-known perceptual audio coders such as MPEG-1 Layer II or III (also known as ".mp3"), MPEG Advanced Audio Coding (AAC), or any other audio coder.
- On the receiving end, the SAOC decoder 820, 920 conceptually tries to restore the original object signals ("object separation") using the transmitted side information 814, 914 (and, naturally, the one or more downmix signals 812, 912). These approximated object signals (also designated as reconstructed object signals

820*b*, 924) are then mixed into a target scene represented by M audio output channels (which may, for example, be represented by the upmix channel signals $\hat{y}_1$ to $\hat{y}_M$, 928) using a rendering matrix. For a mono output, the rendering matrix coefficients are given by $r_1$ to $r_N$ Effectively, the separation of the object signals is rarely executed (or even never executed), since both the separation step (indicated by the object separator 820*a*, 922) and the mixing step (indicated by the mixer 820*c*, 926) are combined into a single transcoding step, which often results in an enormous reduction in computational complexity.

It has been found that such a scheme is tremendously efficient, both in terms of transmission bitrate (it is only needed to transmit a few downmix channels plus some side information instead of N object audio signals) and computational complexity (the processing complexity relates mainly to the number of output channels rather than the number of audio objects). Further advantages for the user on the receiving end include the freedom of choosing a rendering setup of his/her choice (mono, stereo, surround, virtualized headphone playback, and so on) and the feature of user interactivity: the rendering matrix, and thus the output scene, can be set and changed interactively by the user according to will, personal preference or other criteria. For example, it is possible to locate the talkers from one group together in one spatial area to maximize discrimination from other remaining talkers. This interactivity is achieved by providing a decoder user interface:

For each transmitted sound object, its relative level and (for non-mono rendering) spatial position of rendering can be adjusted. This may happen in real-time as the user changes the position of the associated graphical user interface (GUI) sliders (for example: object-level=+5 dB, object position=−30 deg).

In the following, a short reference will be given to techniques, which have been applied previously in the field of channel-based audio coding.

U.S. Ser. No. 11/032,689 describes a process for combining several cue values into a single transmitted one in order to save side information.

This technique is also applied to "multi-channel hierarchal audio coding with compact side information" in U.S. 60/671,544.

However, it has been found that the object-related parametric information, which is used for an encoding of a multi-channel audio content, comprises a comparatively high bit rate in some cases.

SUMMARY

According to an embodiment, an audio signal decoder for providing an upmix signal representation on the basis of a downmix signal representation and an object-related parametric information, and depending on a rendering information, may have an object parameter determinator configured to acquire inter-object-correlation values for a plurality of pairs of audio objects, wherein the object parameter determinator is configured to evaluate a bitstream signaling parameter in order to decide whether to evaluate individual inter-object-correlation bitstream parameter values, to acquire inter-object-correlation values for a plurality of pairs of related audio objects, or to acquire inter-object-correlation values for a plurality of pairs of related audio objects using a common inter-object-correlation bitstream parameter value; and a signal processor configured to acquire the upmix signal representation on the basis of the downmix signal representation and using the inter-object-correlation values for a plurality of pairs of related audio objects and the rendering information; wherein the object-related parametric information has the bitstream signaling parameter and the individual inter-object-correlation bitstream parameter values or the common inter-object-correlation bitstream parameter value; wherein the object parameter determinator is configured to evaluate an object-relationship-information, describing whether two audio objects are related to each other; and wherein the object parameter determinator is configured to selectively acquire inter-object-correlation values for pairs of audio objects, for which the object-relationship-information indicates a relationship, using the common inter-object-correlation bitstream parameter value and to set inter-object-correlation values for pairs of audio objects, for which the object-relationship information indicates no relationship, to a predefined value.

According to another embodiment, an audio signal encoder for providing a bitstream representation on the basis of a plurality of audio object signals may have a downmixer configured to provide a downmix signal on the basis of the audio object signals and in dependence on downmix parameters describing contributions of the audio object signals to one or more channels of the downmix signal; and a parameter provider configured to provide a common inter-object-correlation bitstream parameter value associated with a plurality of pairs of related audio object signals, and to also provide a bitstream signaling parameter indicating that the common inter-object-correlation bitstream parameter value is provided instead of a plurality of individual inter-object-correlation bitstream parameter values; wherein the parameter provider is configured to also provide an object relationship information describing whether two audio objects are related to each other; and a bitstream formatter configured to provide a bitstream having a representation of the downmix signal, a representation of the common inter-object-correlation bitstream parameter value and the bitstream signaling parameter.

According to another embodiment, a method for providing an upmix signal representation on the basis of a downmix signal representation and an object-related parametric information and in dependence on a rendering information may have the steps of acquiring inter-object-correlation values for a plurality of pairs of audio objects, wherein a bitstream signaling parameter is evaluated in order to decide whether to evaluate individual inter-object-correlation bitstream parameter values, to acquire inter-object-correlation values for a plurality of pairs of related audio objects, or to acquire inter-object-correlation values for a plurality of pairs of related audio objects using a common inter-object-correlation bitstream parameter value; and acquiring the upmix signal representation on the basis of the downmix signal representation and using the inter-object-correlation values for a plurality of pairs of related audio objects and the rendering information; wherein an object-relationship information, describing whether two audio objects are related to each other, is evaluated, and wherein the inter-object-correlation values are selectively acquired for pairs of audio objects, for which the object relationship-information indicates a relationship, using the common inter-object-correlation bitstream parameter value, and wherein the inter-object-correlation values are set to a predefined value for pairs of audio objects, for which the object-relationship information indicates no relationship; and wherein the object-related parametric information has the bitstream signaling parameter and the individual inter-object-correlation bitstream parameter values or the common inter-object-correlation bitstream parameter value.

According to another embodiment, a method for providing a bitstream representation on the basis of a plurality of audio object signals may have the steps of providing a downmix signal on the basis of the audio object signals and in dependence on downmix parameters describing contributions of the audio object signals to the one or more channels of the downmix signal; and providing a common inter-object-correlation bitstream parameter value associated with a plurality of pairs of related audio object signals; and providing a bitstream signaling parameter indicating that the common inter-object-correlation bitstream parameter value is provided instead of a plurality of individual inter-object-correlation bitstream parameter values; and providing an object-relationship information describing whether two audio objects are related to each other, providing a bitstream having a representation of the downmix signal, a representation of the common inter-object-correlation bitstream parameter value and the bitstream signaling parameter.

According to another embodiment, a computer program may perform one of the above mentioned methods, when the computer program runs on a computer.

According to another embodiment, a bitstream representing a multi-channel audio signal may have a representation of a downmix signal combining audio signals of a plurality of audio objects; and an object-related parametric side information describing characteristics of the audio objects, wherein the object-related parametric side information has a bitstream signaling parameter indicating whether the bitstream has individual inter-object-correlation bitstream parameter values or a common inter-object-correlation bitstream parameter value, and an object-relationship information describing whether two audio objects are related to each other.

According to another embodiment, an audio signal decoder for providing an upmix signal representation on the basis of a downmix signal representation and an object-related parametric information, and depending on a rendering information, may have an object parameter determinator configured to acquire inter-object-correlation values for a plurality of pairs of audio objects, wherein the object parameter determinator is configured to evaluate a bitstream signaling parameter in order to decide whether to evaluate individual inter-object-correlation bitstream parameter values, to acquire inter-object-correlation values for a plurality of pairs of related audio objects, or to acquire inter-object-correlation values for a plurality of pairs of related audio objects using a common inter-object-correlation bitstream parameter value; and a signal processor configured to acquire the upmix signal representation on the basis of the downmix signal representation and using the inter-object-correlation values for a plurality of pairs of related audio objects and the rendering information; wherein the audio signal decoder is configured to combine an inter-object-correlation value $IOC_{i,j}$ associated with a pair of related audio objects with an object level difference value $OLD_i$ describing an object level of a first audio object of the pair of related audio objects and with an object level difference value $OLD_j$ describing an object level of a second audio object of the pair of related audio objects, to acquire a covariance value $e_{i,j}$ associated with the pair of related audio objects; wherein the audio decoder is configured to acquire an element $e_{i,j}$ of a covariance matrix according to $e_{i,j}=\sqrt{OLD_i OLD_j}IOC_{i,j}$.

According to another embodiment, a method for providing an upmix signal representation on the basis of a downmix signal representation and an object-related parametric information and in dependence on a rendering information, may have the steps of acquiring inter-object-correlation values for a plurality of pairs of audio objects, wherein a bitstream signaling parameter is evaluated in order to decide whether to evaluate individual inter-object-correlation bitstream parameter values, to acquire inter-object-correlation values for a plurality of pairs of related audio objects, or to acquire inter-object-correlation values for a plurality of pairs of related audio objects using a common inter-object-correlation bitstream parameter value; and acquiring the upmix signal representation on the basis of the downmix signal representation and using the inter-object-correlation values for a plurality of pairs of related audio objects and the rendering information; wherein an inter-object-correlation value $IOC_{i,j}$ associated with a pair of related audio objects is combined with an object level difference value $OLD_i$ describing an object level of a first audio object of the pair of related audio objects and with an object level difference value $OLD_j$ describing an object level of a second audio object of the pair of related audio objects, to acquire a covariance value $e_{i,j}$ associated with the pair of related audio objects; wherein an element $e_{i,j}$ of a covariance matrix is acquired according to $e_{i,j}=\sqrt{OLD_i OLD_j}IOC_{i,j}$.

According to another embodiment, a computer program may perform the above-mentioned method, when the computer program runs on a computer.

An embodiment according to the invention creates an audio signal decoder for providing an upmix signal representation on the basis of a downmix signal representation and an object-related parametric information and in dependence on a rendering information. The apparatus comprises an object-parameter determinator configured to obtain inter-object-correlation values for a plurality of pairs of audio objects. The object-parameter determinator is configured to evaluate a bitstream signalling parameter in order to decide whether to evaluate individual inter-object-correlation bitstream parameter values to obtain inter-object-correlation values for a plurality of pairs of related audio objects or to obtain inter-object-correlation values for a plurality of pairs of related audio objects using a common inter-object-correlation bitstream parameter value. The audio signal decoder also comprises a signal processor configured to obtain the upmix signal representation on the basis of the downmix signal representation and using the inter-object-correlation values for a plurality of pairs of related audio objects and the rendering information.

This audio signal decoder is based on the key idea that a bit rate needed for encoding inter-object-correlation values can be excessively high in some cases in which correlations between many pairs of audio objects need to be considered in order to obtain a good hearing impression, and that a bit rate needed to encode the inter-object-correlation values can be significant reduced in such cases by using a common inter-object-correlation bitstream parameter value rather than individual inter-object-correlation bitstream parameter values without significantly compromising the hearing impression.

It has been found that in situations in which there are notable inter-object-correlations between many pairs of audio objects, which should be considered in order to obtain a good hearing impression, a consideration of the inter-object-correlations would normally result in a high bitrate requirement for the inter-object-correlation bitstream parameter values. However, it has been found that in such situations, in which there is a non-negligible inter-object-correlation between many pairs of audio objects, a good hearing impression can be achieved by merely encoding a single common inter-object-correlation bitstream parameter value, and by deriving the inter-object-correlation values for a plurality of pairs of related audio objects from such a common inter-object-correlation bitstream parameter value. Accordingly, the correlation between many audio objects can be considered with sufficient accuracy in most cases, while keeping the effort for the transmission of the inter-object-correlation bitstream parameter value sufficiently small.

Therefore, the above-discussed concept results in a small bit rate demand for the object-related side information in some acoustic environments in which there is a non-negligible inter-object-correlation between many different audio object signals, while still achieving a sufficiently good hearing impression.

In an embodiment, the object-parameter determinator is configured to set the inter-object-correlation value for all pairs of different related audio objects to a common value defined by the common inter-object-correlation bitstream parameter value. It has been found that this simple solution brings along a sufficiently good hearing impression in many relevant situations.

In an embodiment, the object-parameter determinator is configured to evaluate an object-relationship information describing whether two objects are related to each other or not. The object-parameter determinator is further configured to selectively obtain inter-object-correlation values for pairs of audio objects for which the object-relationship information indicates a relationship using the common inter-object-correlation bitstream parameter value, and to set inter-object-correlation values for pairs of audio objects for which the object-relationship information indicates no relationship to a predefined value (for example, to zero). Accordingly, it can be distinguished, with high bitrate efficiency, between related and unrelated audio objects. Therefore, an allocation of a non-zero inter-object-correlation value to pairs of audio objects, which are (approximately) unrelated, is avoided. Accordingly, a degradation of a hearing impression is avoided and a separation between such approximately unrelated audio objects is possible. Moreover, the signalling of related and unrelated audio objects can be performed with very high bitrate efficiency, because the audio object relationship is typically time-invariant over a piece of audio, such that the needed bitrate for this signalling is typically very low. Thus, the described concept brings along a very good trade-off between bitrate efficiency and hearing impression.

In an embodiment, the object parameter determinator is configured to evaluate an object-relationship information comprising a one-bit flag for each combination of different audio objects, wherein the one-bit flag associated to a given combination of different audio objects indicates whether the audio objects of the given combination are related or not. Such an information can be transmitted very efficiently and results in a significant reduction of the needed bit rate to achieve a good hearing impression.

In an embodiment, the object-parameter determinator is configured to set the inter-object-correlation values for all pairs of different related audio objects to a common value defined by the common inter-object-correlation bitstream parameter value.

In an embodiment, the object-parameter determinator comprises a bitstream parser configured to parse a bitstream representation of an audio content to obtain the bitstream signalling parameter and the individual inter-object-correlation bitstream parameters or the common inter-object-correlation bitstream parameter. By using a bitstream parser, the bitstream signalling parameter and the individual inter-object-correlation bitstream parameters or the common inter-object-correlation bitstream parameter can be obtained with good implementation efficiency.

In an embodiment, the audio signal decoder is configured to combine an inter-object-correlation value associated with a pair of related audio objects with an object-level difference parameter value describing an object level of a first audio object of the pair of related audio objects and with an object-level difference parameter value describing an object level of a second audio object of the pair of related audio objects to obtain a covariance value associated with the pair of related audio objects. Accordingly, it is possible to derive the covariance value associated to a pair of related audio objects such that the covariance value is adapted to the pair of audio objects even though a common inter-object-correlation parameter is used. Therefore, different covariance values can be obtained for different pairs of audio objects. In particular, a large number of different covariance values can be obtained using the common inter-object-correlation bitstream parameter value.

In an embodiment, the audio signal decoder is configured to handle three or more audio objects. In this case, the object-parameter determinator is configured to provide inter-object-correlation values for every pair of different audio objects. It has been found that meaningful values can be obtained using the inventive concept even if there are a relatively large number of audio objects, which are all related to each other. Obtaining inter-object-correlation values from many combinations of audio objects is particularly helpful when encoding and decoding audio object signals using an object-related parametric side information.

In an embodiment, the object-parameter determinator is configured to evaluate the bitstream signalling parameter, which is included in a configuration bitstream portion, in order to decide whether to evaluate individual inter-object-correlation bitstream parameter values to obtain inter-object-correlation values for a plurality of pairs of related audio objects or to obtain inter-object-correlation values for a plurality of pairs of related audio objects using a common inter-object-correlation bitstream parameter value. In this embodiment, the object-parameter determinator is configured to evaluate an object relationship information, which is included in the configuration bitstream portion, to determine whether the audio objects are related. In addition, the object-parameter determinator is configured to evaluate a common inter-object-correlation bitstream parameter value, which is included in a frame data bitstream portion, for every frame of the audio content if it is decided to obtain inter-object-correlation values for a plurality of pairs of related audio objects using a common inter-object-correlation bitstream parameter value. Accordingly, a high bitrate efficiency is obtained, because the comparatively large object relationship information is evaluated only once per audio piece (which is defined by the presence of a configuration bitstream portion), while the comparatively small common inter-object-correlation bitstream parameter value is evaluated for every frame of the audio piece, i.e. multiple times per audio piece. This reflects the finding that the relationship between audio objects typically does not change within an audio piece or only changes very rarely. Accordingly, a good hearing impression can be obtained at a reasonably low bitrate.

Alternatively, however, the usage of a common inter-object-correlation bitstream parameter value could be signaled in a frame data bitstream portion, which would, for example, allow for a flexible adaptation to varying audio contents.

An embodiment according to the invention creates an audio signal encoder for providing a bitstream representation on the basis of a plurality of audio object signals. The audio signal encoder comprises a downmixer configured to provide a downmix signal on the basis of the audio object signals and in dependence on downmix parameters describing contributions of the audio object signals to be one or more channels of the downmix signal. The audio signal encoder also comprises a parameter provider configured to provide a common inter-object-correlation bitstream parameter value associated with a plurality of pairs of related audio object signals and to also provide a bitstream signalling parameter indicating that the common inter-object-correlation bitstream parameter value is provided instead of a plurality of individual inter-object-correlation bitstream parameters. The audio signal encoder also comprises a bitstream formatter configured to provide a bitstream comprising a representation of the downmix signal, a representation of the common inter-object-correlation bitstream parameter value and the bitstream signalling parameter.

This embodiment, according to the invention, allows for a provision of a bitstream representing a multi-channel audio content with compact side information. By providing a common inter-object-correlation bitstream parameter value, the object-related side information is held compact, while still providing efficient information for a reproduction of the multi-channel audio content with a good hearing impression. In addition, it should be noted that the audio signal encoder described here provides for the same advantages which have been discussed with respect to the audio signal decoder.

In an embodiment, the parameter provider is configured to provide the common inter-object-correlation bitstream parameter value in dependence on a ratio between a sum of cross-power terms and a sum of average power terms. It has been found that such an inter-object-correlation bitstream parameter value can be computed with moderate computational effort, while still providing an accurate hearing impression in most cases.

In another embodiment according to the invention, the parameter provider is configured to provide a predetermined constant value as the common inter-object-correlation bitstream parameter value. It has been found that in some cases, the provision of a constant value makes sense. For example, for certain standard microphone arrangements in certain types of conference rooms, a constant value may be very well suited to represent a desired hearing impression. Accordingly, the computational effort can be minimized while providing a good hearing impression in many standard applications of the inventive concept.

In another embodiment, the parameter provider is configured to also provide an object-relationship information describing whether two audio objects are related to each other. Such an object-relationship information can be exploited by the audio decoder, as discussed above. Accordingly, it can be ensured that the common inter-object-correlation bitstream parameter value is only applied for such audio objects, which are, indeed, related to each other, but is not applied to entirely unrelated audio objects.

In an embodiment, the parameter provider is configured to selectively evaluate an inter-object-correlation of audio objects for which the object-relationship information indicates a relationship for a computation of the common inter-object-correlation bitstream parameter value. This allows to have a particularly meaningful inter-object-correlation bitstream parameter value.

Further embodiments according to the invention create a method for providing an upmix signal representation and a method for providing a bitstream representation. These methods are based on the same ideas as the above-discussed audio decoder and audio encoder.

Another embodiment according to the invention creates a bitstream representing a multi-channel audio signal. The bitstream comprises a representation of a downmix signal combining audio signals of a plurality of audio objects. The bitstream also comprises an object-related parametric side information describing characteristics of the audio objects. The object-related parametric side information comprises a bitstream signaling parameter indicating whether the bitstream comprises individual inter-object-correlation bitstream parameter values or a common inter-object-correlation bitstream parameter value. Accordingly, the bitstream allows for a flexible usage for the transmission of different types of audio-channel contents. In particular, the bitstream allows for both the transmission of the individual inter-object-correlation bitstream parameter values or of the common inter-object-correlation bitstream parameter value, whichever is more suited for the auditory scene. Accordingly, the bitstream is well-suited for handling both cases in which there is a comparatively small number of related audio objects for which detailed (object-individual) inter-object-correlation information should be transmitted and for cases in which there is a comparatively large number of related audio objects for which a transmission of individual inter-object-correlation bitstream parameter values would result in an excessively high bitrate demand and for which a common inter-object-correlation bitstream parameter value still allows for a reproduction with a good hearing impression.

BRIEF DESCRIPTION OF THE DRAWINGS

Embodiments according to the invention will subsequently be described taking reference to the enclosed Figs. in which:

FIG. 5 shows a syntax representation of an SAOC specific configuration information, which may be part of a bitstream;

FIG. 6 shows a syntax representation of an SAOC frame information, which may be part of a bitstream;

DETAILED DESCRIPTION OF THE INVENTION

1. Audio Signal Decoder According to FIG. 1

Figure 1:
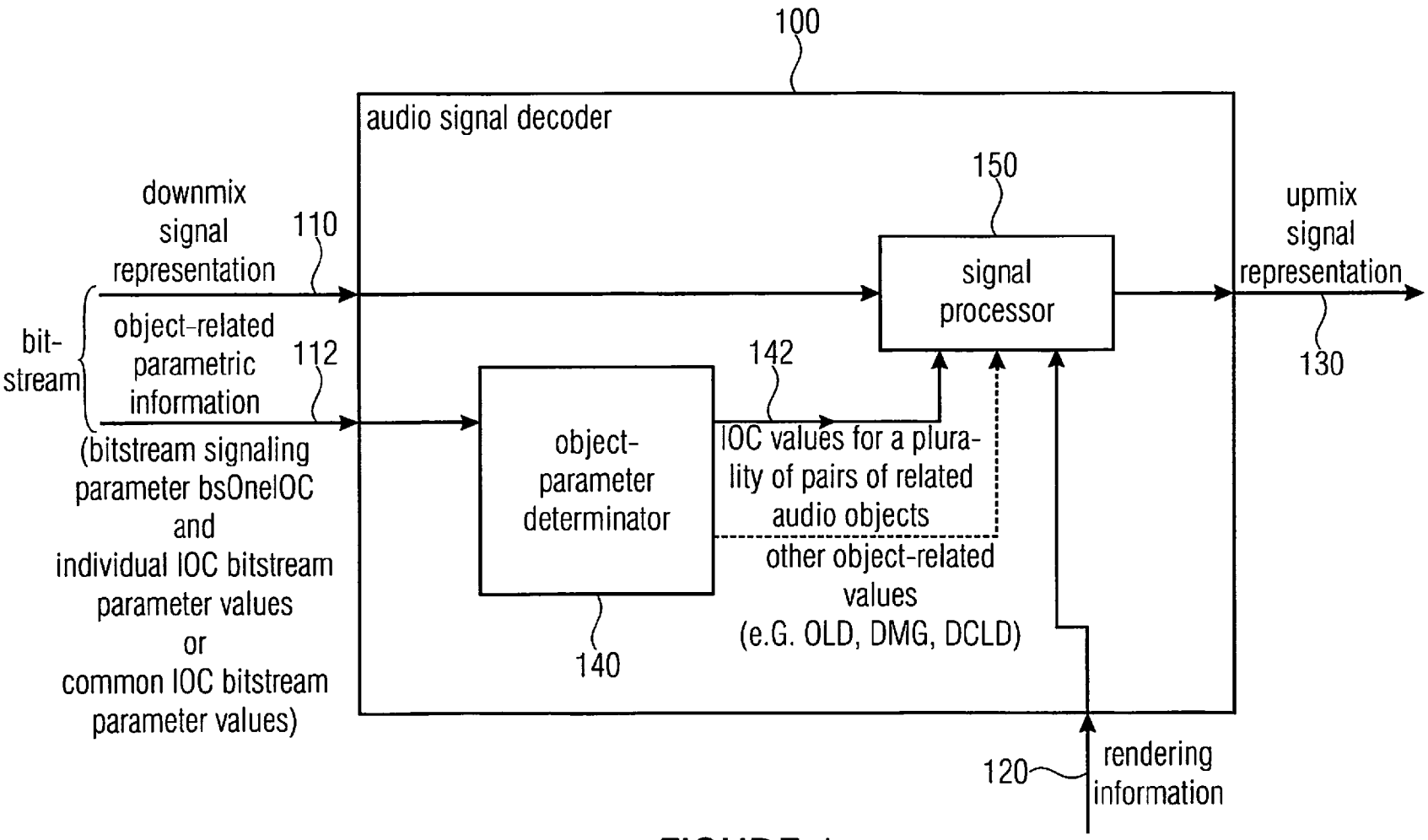
FIG. 1 shows a block schematic diagram of an audio signal decoder according to an embodiment of the invention.

In the following, an audio signal decoder 100 will be described taking reference to FIG. 1, which shows a block schematic diagram of such an audio signal decoder 100.

Firstly, input and output signals of the audio signal decoder 100 will be described. Subsequently, the structure of the audio signal decoder 100 will be described and, finally, the functionality of the audio signal decoder 100 will be discussed.

The audio signal decoder 100 is configured to receive a downmix signal representation 110, which typically represents a plurality of audio object signals, for example, in the form of a one-channel audio signal representation or a two-channel audio signal representation.

The audio signal decoder 100 also receives an object-related parametric information 112, which typically describes the audio objects, which are included in the downmix signal representation 110.

For example, the object-related parametric information 112 describes object levels of the audio objects, which are represented by the downmix signal representation 110, using object-level difference values (OLD).

In addition, the object-related parametric information 112 typically represents inter-object-correlation characteristics of the audio objects, which are represented by the downmix signal representation 110. The object-related parametric information typically comprises a bitstream signalling parameter (also designated with "bsOneIOC" herein), which signals whether the object-rated parametric information comprises individual inter-object-correlation bitstream parameter values associated to individual pairs of audio objects or a common inter-object-correlation bitstream parameter value associated with a plurality of pairs of audio objects. Accordingly, the object-related parametric information comprises the individual inter-object-correlation bitstream parameter values or the common inter-object-correlation bitstream parameter value, in accordance with the bitstream signalling parameter "bsOneIOC".

The object-related parametric information 112 may also comprise downmix information describing a downmix of the individual audio objects into the downmix signal representation. For example, the object-related parametric information comprises a downmix gain information DMG describing a contribution of the audio object signals to the downmix signal representation 110. In addition, the object-related parametric information may, optionally, comprise a downmix-channel-level-difference information DCLD describing downmix gain differences between different downmix channels.

The signal decoder 100 is also configured to receive a rendering information 120, for example, from a user interface for inputting said rendering information. The rendering information describes an allocation of the signals of the audio objects to upmix channels. For example, the rendering information 120 may take the form of a rendering matrix (or entries thereof). Alternatively, the rendering information 120 may comprise a description of a desired rendering position (for example, in terms of spatial coordinates) of the audio objects and desired intensities (or volumes) of the audio objects.

The audio signal decoder 100 provides an upmix signal representation 130, which constitutes a rendered representation of the audio object signals described by the downmix signal representation and the object-related parametric information. For example, the upmix signal representation may take the form of individual audio channel signals, or may take the form of a downmix signal representation in combination with a channel-related parametric side information (for example, MPEG-Surround side information).

The audio signal decoder 100 is configured to provide the upmix signal representation 130 on the basis of the downmix signal representation 110 and the object-related parametric information 112 and in dependence on the rendering information 120. The apparatus 100 comprises an object-parameter determinator 140, which is configured to obtain inter-object-correlation values (at least) for a plurality of pairs of related audio objects on the basis of the object-related parametric information 112. For this purpose, the object-parameter determinator 140 is configured to evaluate the bitstream signalling parameter ("bsOneIOC") in order to decide whether to evaluate individual inter-object-correlation bitstream parameter values to obtain the inter-object-correlation values for a plurality of pairs of related audio objects or to obtain the inter-object-correlation values for a plurality of pairs of related audio objects using a common inter-object-correlation bitstream parameter value. Accordingly, the object-parameter determinator 140 is configured to provide the inter-object-correlation values 142 for a plurality of pairs of related audio objects on the basis of individual inter-object-correlation bitstream parameter values if the bitstream signaling parameter indicates that a common inter-object-correlation bitstream parameter value is not available. Similarly, the object-parameter determinator determines the inter-object-correlation values 142 for a plurality of pairs of related audio objects on the basis of the common inter-object-correlation bitstream parameter value if the bitstream signaling parameter indicates that such a common inter-object-correlation bitstream parameter value is available.

The object-parameter determinator also typically provides other object-related values, like, for example, object-level-difference values OLD, downmix-gain values DMG and (optionally) downmix-channel-level-difference values DCLD on the basis of the object-related parametric information 112.

The audio signal decoder 100 also comprises an signal processor 150, which is configured to obtain the upmix signal representation 130 on the basis of the downmix signal representation 110 and using the inter-object-correlation values 142 for a plurality of pairs of related audio objects and the rendering information 120. The signal processor 150 also uses the other object-related values, like object-level-difference values, downmix-gain values and downmix-channel-level-difference values.

The signal processor 150 may, for example, estimate statistic characteristics of a desired upmix signal representation 130 and process the downmix signal representation such that the upmix signal representation 130 derive from the downmix signal representation comprises the desired statistic characteristics. Alternatively, the signal processor 150 may try to separate the audio object signals of the plurality of audio objects, which are combined in the downmix signal representation 110, using the knowledge about the object characteristics and the downmix process. Accordingly, the signal processor may calculate a processing rule (for example, a scaling rule or a linear combination rule), which would allow for a reconstruction of the individual audio object signals or at least of audio signals having similar statistical characteristics as the individual audio object signals. The signal processor 150 may then apply the desired rendering to obtain the upmix signal representation.

Naturally, the computation of reconstructed audio object signals, which approximate the original individual audio object signals, and the rendering can be combined in a single processing step in order to reduce the computational complexity.

To summarize the above, the audio signal decoder is configured to provide the upmix signal representation 130 on the basis of the downmix signal representation 110 and the object-related parametric information 112 using the rendering information 120. The object-related parametric information 112 is evaluated in order to have a knowledge about the statistical characteristics of the individual audio object signals and of the relationship between the individual audio object signals, which is needed by the signal processor 150. For example, the object-related parametric information 112 is used in order to obtain an estimated variance matrix describing estimated covariance values of the individual audio object signals. The estimated covariance matrix is then applied by the signal processor 150 in order to determine a processing rule (for example, as discussed above) for deriving the upmix signal representation 130 from the downmix signal representation 110, wherein, naturally, other object-related information may also be exploited.

The object-parameter determinator 140 comprises different modes in order to obtain the inter-object-correlation values for a plurality of pairs of related audio objects, which constitutes an important input information for the signal processor 150. In a first mode, the inter-object-correlation values are determined using individual inter-object-correlation bitstream parameter values. For example, there may be one individual inter-object-correlation bitstream parameter value for each pair of related audio objects, such that the object-parameter determinator 140 simply maps such an individual inter-object-correlation bitstream parameter value onto one or two inter-object-correlation values associated with a given pair of related audio objects. On the other hand, there is also a second mode of operation, in which the object-parameter determinator 140 merely reads a single common inter-object-correlation bitstream parameter value from the bitstream and provides a plurality of inter-object-correlation values for a plurality of different pairs of related audio objects on the basis of this single common inter-object-correlation bitstream parameter value. Accordingly, the inter-object-correlation values for a plurality of pairs of related audio objects may, for example, be identical to the value represented by the single common inter-object-correlation bitstream parameter value, or may be derived from the same common inter-object-correlation bitstream parameter value. The object-parameter determinator 140 is switchable between said first mode and said second mode in dependence on the bitstream signalling parameter ("bsOneIOC").

Accordingly, there are different modes for the provision of the inter-object-correlation values, which can be applied by the object-parameter determinator 140. If there is a relatively small number of pairs of related audio objects, the inter-object-correlation values for said pairs of related audio objects are typically (in dependence on the bitstream signaling parameter) determined individually by the object-parameter determinator, which allows for a particularly precise representation of the characteristics of said pairs of related audio objects and, consequently, brings along the possibility of reconstructing the individual audio object signals with good accuracy in the signal processor 150. Thus, it is typically possible to provide a good hearing impression in such a case in which only correlations between a comparatively small number of pairs of related audio objects are relevant.

The second mode of operation of the object-parameter determinator, in which a common inter-object-correlation bitstream parameter value is used to obtain inter-object-correlation values for a plurality of pairs of related audio objects, is typically used in cases in which there are non-negligible correlations between a plurality of pairs of audio objects. Such cases could conventionally not be handled without excessively increasing the bitrate of a bitstream representing both the downmix signal representation 110 and the object-related parametric information 112. The usage of a common inter-object-correlation bitstream parameter value brings along specific advantages if there are non-negligible correlations between a comparatively large number of pairs of audio objects, which correlations do not comprise acoustically significant variations. In this case, it is possible to consider the correlations with moderate bitrate effort, which brings along a reasonably good compromise between bitrate requirement and quality of the hearing impression.

Accordingly, the audio signal decoder 100 is capable of efficiently handling different situations, namely situations in which there are only a few pairs of related audio objects, the inter-object-correlation of which should be taken into consideration with high precision, and situations in which there is a large number of pairs of related audio objects, the inter-object-correlations of which should not be neglected entirely but have some similarity. The audio signal decoder 100 is capable of handling both situations with a good quality of the hearing impression.

2. Audio Signal Encoder According to FIG. 2

Figure 2:
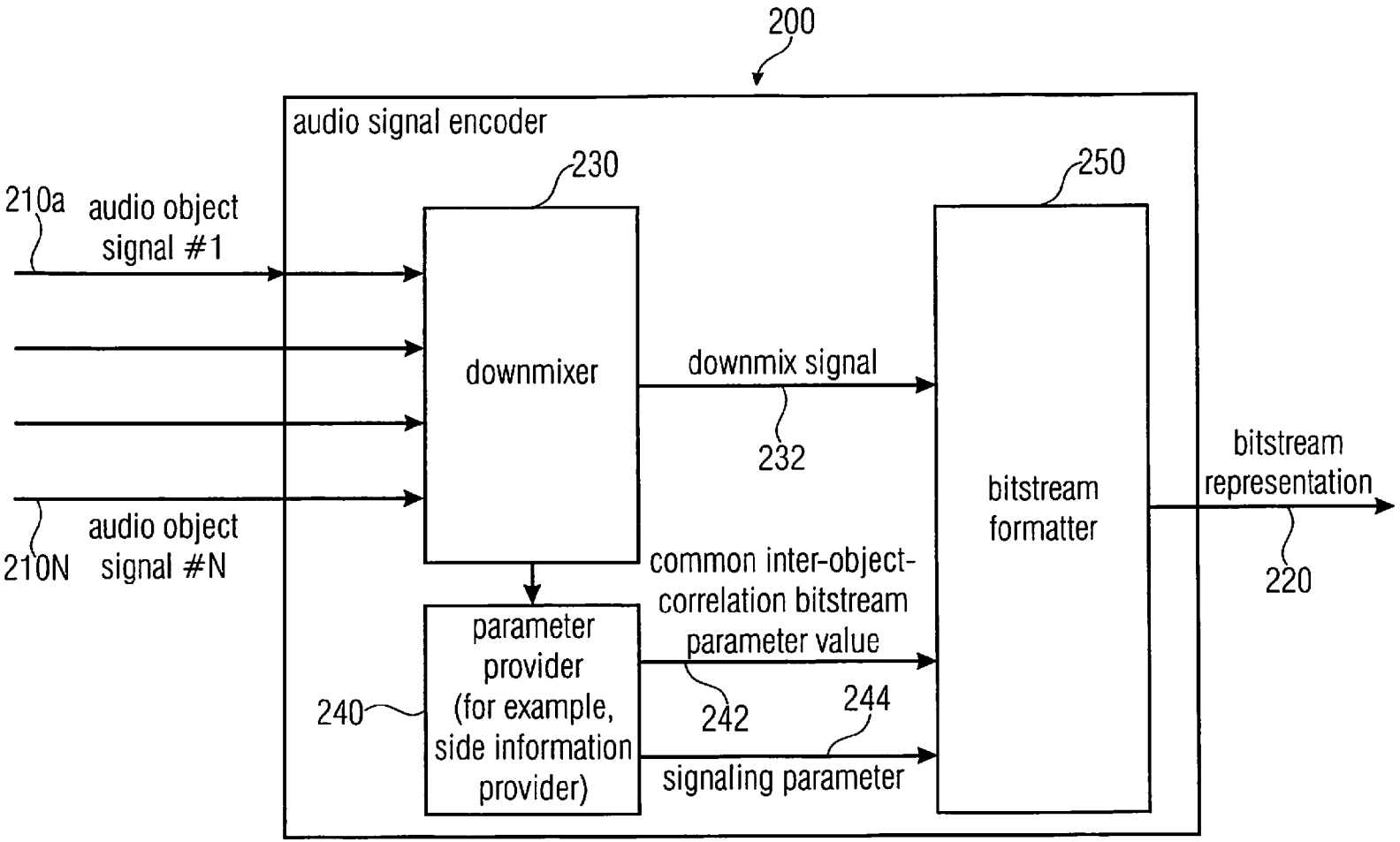
FIG. 2 shows a block schematic diagram of an audio signal encoder according to an embodiment of the invention.

In the following, an audio signal encoder 200 will be described taking reference to FIG. 2, which shows a block schematic diagram of such an audio signal encoder 200.

The audio signal encoder 200 is configured to receive a plurality of audio object signals 210*a* to 210N. The audio object signals 210*a* to 210N may, for example, be one-channel signals or two-channel signals representing different audio objects.

The audio signal encoder 200 is also configured to provide a bitstream representation 220, which describes the auditory scene represented by the audio object signals 210*a* to 210N in a compact and bitrate-efficient manner.

The audio signal encoder 200 comprises a downmixer 220, which is configured to receive the audio object signals 210*a* to 210N and to provide a downmix signal 232 on the basis of the audio object signals 210*a* to 210N. The downmixer 230 is configured to provide the downmix signal 232 in dependence on downmix parameters describing contributions of the audio object signals 210*a* to 210N to the one or more channels of the downmix signal.

The audio signal encoder also comprises a parameter provider 240, which is configured to provide a common inter-object-correlation bitstream parameter value 242 associated with a plurality of pairs of related audio object signals 210*a* to 210N. The parameter provider 240 is also configured to provide a bitstream signalling parameter 244 indicating that the common inter-object-correlation bitstream parameter value 242 is provided instead of a plurality of individual inter-object-correlation bitstream parameters (individually associated with different pairs of audio objects).

The audio signal encoder 200 also comprises a bitstream formatter 250, which is configured to provide a bitstream representation 250 comprising a representation of the downmix signal 232 (for example, an encoded representation of the downmix signal 232), a representation of the common inter-object-correlation bitstream parameter value 242 (for example, a quantized and encoded representation thereof) and the bitstream signalling parameter 244 (for example, in the form of a one-bit parameter value).

The audio signal decoder 200 consequently provides a bitstream representation 220, which represents the audio scene described by the audio object signals 210*a* to 210N with good accuracy. In particular, the bitstream representation 220 comprises a compact side information if many of the audio object signals 210*a* to 210N are related to each other, i.e. comprise a non-negligible inter-object-correlation. In this case, the common inter-object-correlation bitstream parameter value 242 is provided instead of individual inter-object-correlation bitstream parameter values individually associated with pairs of audio objects. Accordingly, the audio signal encoder can provide a compact bitstream representation 220 in any case, both if there are many related pairs of audio object signals 210*a* to 210N and if there are only a few pairs of related audio object signals 210*a* to 210N. In particular the bitstream representation 220 may comprise the information needed by the audio signal decoder 100 as an input information, namely the downmix signal representation 110 and the object-related parametric information 112. Thus, the parameter provider 240 may be configured to provide additional object-related parametric information describing the audio object signals 210*a* to 210N as well as the downmix process performed by the downmixer 230. For example, the parameter provider 240 may additionally provide an object-level-difference information OLD describing the object levels (or object-level differences) of the audio object signals 210*a* to 210N. Furthermore, the parameter provider 240 may provide a downmix-gain information DMG describing downmix gains applied to the individual audio object signals 210*a* to 210N when forming the one or more channels of the downmix signal 232. Downmix-channel-level-difference values DCLD, which describe downmix gain differences between different channels of the downmix signal 232, may also, optionally, be provided by the parameter provider 240 for inclusion into the bitstream representation 220.

To summarize the above, the audio signal encoder efficiently provides the object-related parametric information needed for a reconstruction of the audio scene described by the audio object signals 210*a* to 210N with a good hearing impression, wherein a compact common inter-object-correlation bitstream parameter value is used if there is a large number of related pairs of audio objects. This is signaled using the bitstream signaling parameter 244. Thus, an excessive bitstream load is avoided in such a case.

Further details regarding the provision of a bitstream representation will be described below.

3. Bitstream According to FIG. 3

Figure 3:
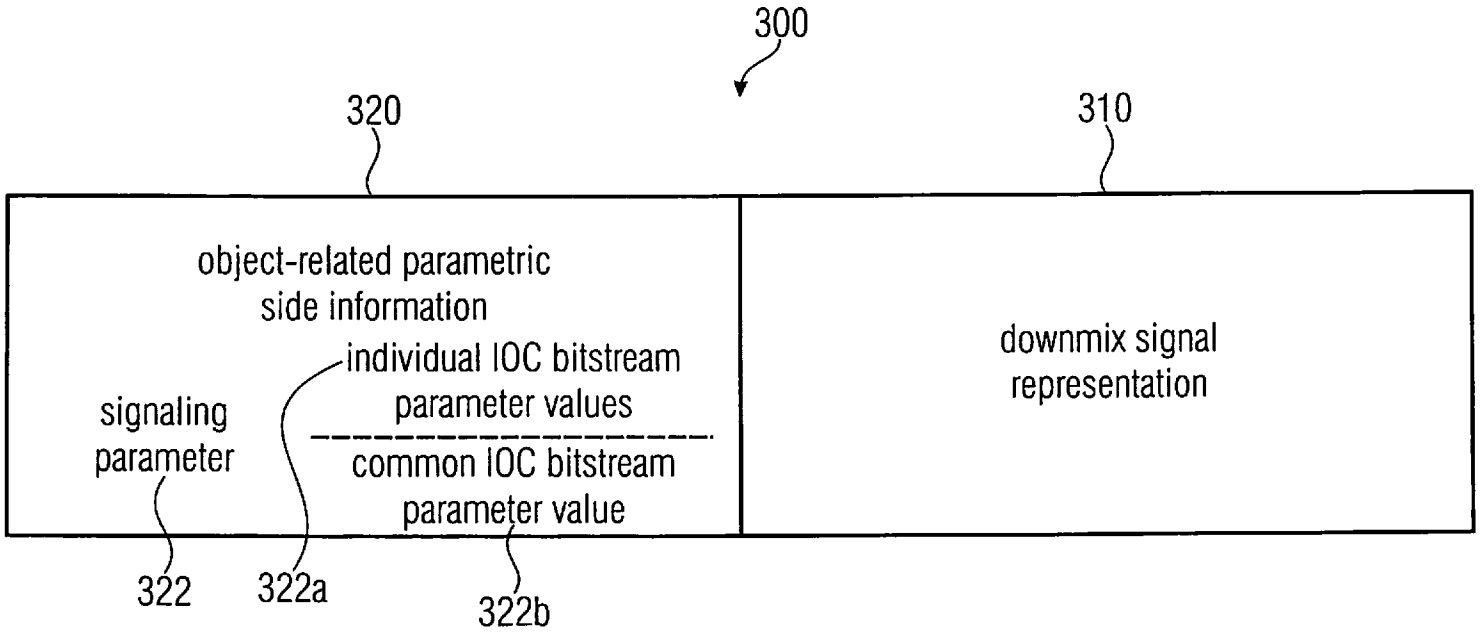
FIG. 3 shows a schematic representation of a bitstream according to an embodiment of the invention.

FIG. 3 shows a schematic representation of a bitstream 300, according to an embodiment of the invention.

The bitstream 300 may, for example, serve as an input bitstream of the audio signal decoder 100, carrying the downmix signal representation 110 and the object-related parametric information 112. The bitstream 300 may be provided as an output bitstream 220 by the audio signal encoder 200.

The bitstream 300 comprises a downmix signal representation 310, which is a representation of a one-channel or multi-channel downmix signal (for example, the downmix signal 232) combining audio signals of a plurality of audio objects. The bitstream 300 also comprises object-related parametric side information 320 describing characteristics of the audio objects, the audio object signals of which are represented, in a combined form, by the downmix signal representation 310. The object-related parametric side information 320 comprises a bitstream signaling parameter 322 indicating whether the bitstream comprises individual inter-object-correlation bitstream parameters (individually associated with different pairs of audio objects) or a common inter-object-correlation bitstream parameter value (associated with a plurality of different pairs of audio objects). The object-related parametric side information also comprises a plurality of individual inter-object-correlation bitstream parameter values 324*a*, which is indicated by a first state of the bitstream signaling parameter 322, or a common inter-object-correlation bitstream parameter value, which is indicated by a second state of the bitstream signaling parameter 322.

Accordingly, the bitstream 300 may be adapted to the relationship characteristics of the audio object signals 210*a* to 210N by adapting the format of the bitstream 300 to contain a representation of individual inter-object-correlation bitstream parameter values or a representation of a common inter-object-correlation bitstream parameter value.

The bitstream 300 may, consequently, provide the chance of efficiently encoding different types of audio scenes with a compact side information, while maintaining the change of obtaining a good hearing impression for the case that there are only a few strongly-correlated audio objects.

Further details regarding the bitstream will subsequently be discussed.

4. The MPEG SAOC System According to FIG. 4

In the following, an MPEG SAOC system using a single IOC parameter calculation will be described taking reference to FIG. 4.

Figure 4:
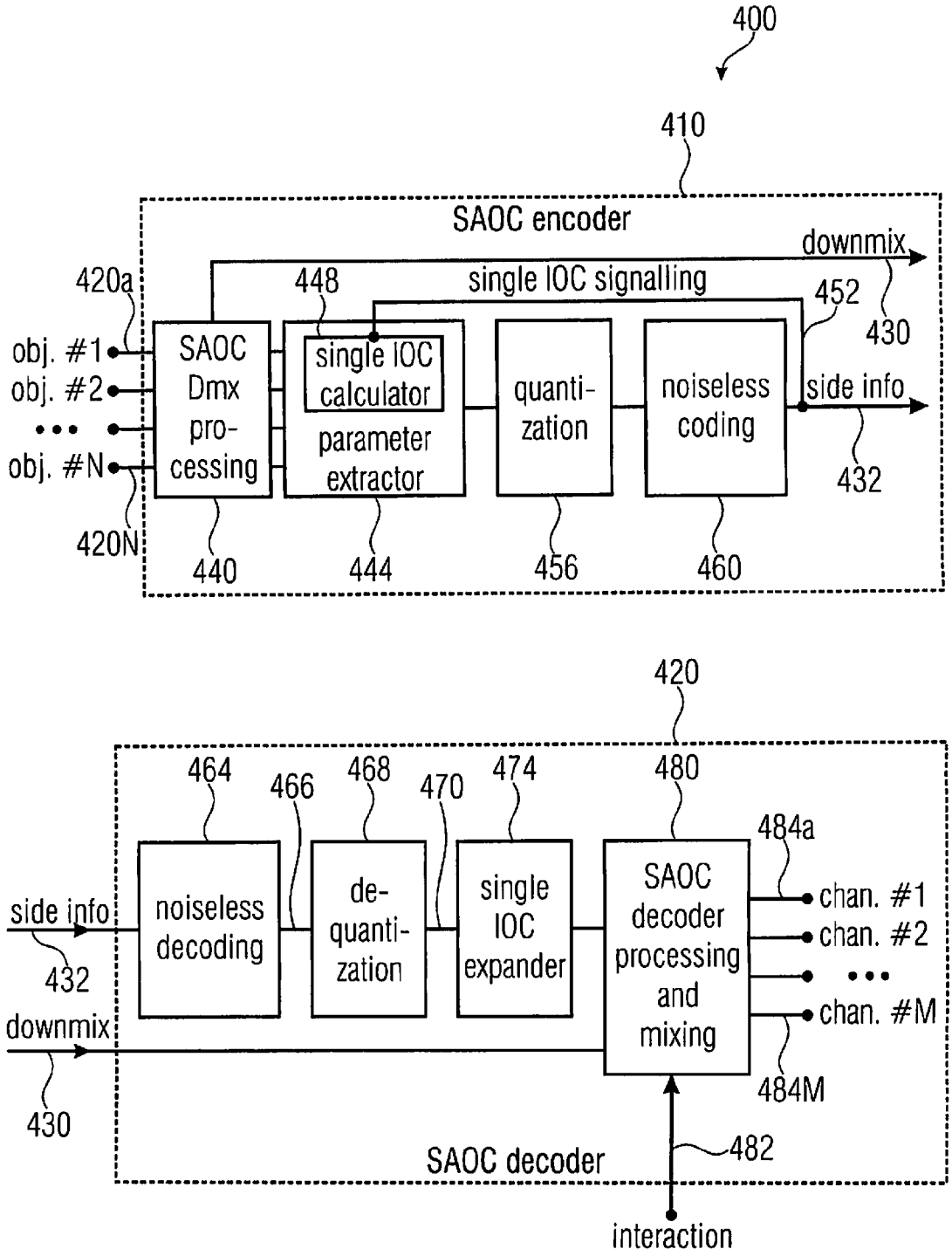
FIG. 4 shows a block schematic diagram of an MPEG SAOC system using a single inter-object-correlation parameter calculation.

The MPEG SAOC system 400 according to FIG. 4 comprises an SAOC encoder 410 and an SAOC decoder 420.

The SAOC encoder 410 is configured to receive a plurality of, for example, L audio object signals 420*a* to 420N. The SAOC encoder 410 is configured to provide a downmix signal representation 430 and a side information 432, which are advantageously, but not necessarily, included in a bitstream.

The SAOC encoder 410 comprises an SAOC downmix processing 440, which receives the audio object signals 420*a* to 420N and provides the downmix signal representation 430 on the basis thereof. The SAOC encoder 410 also comprises a parameter extractor 444, which may receive the object signals 420*a* to 420N and which may, optionally, also receive an information about the SAOC downmix processing 440 (for example, one or more downmix parameters). The parameter extractor 444 comprises a single inter-object-correlation calculator 448, which is configured to calculate a single (common) inter-object-correlation value associated with a plurality of pairs of audio objects. In addition, the single inter-object-correlation calculator 448 is configured to provide a single inter-object-correlation signaling 452, which indicates if a single inter-object-correlation value is used instead of object-pair-individual inter-object-correlation values. The single inter-object-correlation calculator 448 may, for example, decide on the basis of an analysis of the audio object signals 420*a* to 420N whether a single common inter-object-correlation value (or, alternatively, a plurality of individual inter-object-correlation parameter values associated individually with pairs of audio object signals) are provided. However, the single inter-object-correlation calculator 448 may also receive an external control information determining whether a common inter-object-correlation value (for example, a bitstream parameter value) or individual inter-object-correlation values (for example, bitstream parameter values) should be calculated.

The parameter extractor 444 is also configured to provide a plurality of parameters describing the audio object signals 420*a* to 420N, like, for example, object-level difference parameters. The parameter extractor 444 is also advantageously configured to provide parameters describing the downmix, like, for example, a set of downmix-gain parameters DMG and a set of downmix-channel-level-difference parameters DCLD.

The SAOC encoder 410 comprises a quantization 456, which quantizes the parameters provided by the parameter extractor 444. For example, the common inter-object-correlation parameter may be quantized by the quantization 456. In addition, the object-level-difference parameters, the downmix-gain parameters and the downmix-channel-level-difference parameters may also be quantized by the quantization 456. Accordingly, the quantized parameters are obtained by the quantization 456.

The SAOC encoder 410 also comprises a noiseless coding 460, which is configured to encode the quantized parameters provided by the quantization 456. For example, the noiseless coding may noiselessly encode the quantized common inter-object-correlation parameter and also the other quantized parameters (for example, OLD, DMG and DCLD).

Accordingly, the SAOC decoder 410 provides the side information 432 such that the side information comprises the single IOC signaling 452 (which may be considered as a bitstream signaling parameter) and the noiselessly-coded parameters provided by the noiseless coding 480 (which may be considered as bitstream parameter values).

The SAOC decoder 420 is configured to receive the side information 432 provided by the SAOC encoder 410 and the downmix signal representation 430 provided by the SAOC encoder 410.

The SAOC decoder 420 comprises a noiseless decoding 464, which is configured to reverse the noiseless coding 460 of the side information 432 performed in the encoder 410. The SAOC decoder 420 also comprises a de-quantization 468, which may also be considered as an inverse quantization (even though, strictly speaking, quantization is not invertible with perfect accuracy), wherein the de-quantization 468 is configured to receive the decoded side information 466 from the noiseless decoding 464. The de-quantization 468 provides the dequantized parameters 470, for example, the decoded and de-quantized common inter-object-correlation value provided by the single inter-object-correlation calculator 448 and also decoded and de-quantized object-level difference values OLD, decoded and de-quantized downmix-gain values DMG and decoded and de-quantized downmix-channel-level-difference values DCLD. The SAOC decoder 420 also comprises a single inter-object-correlation expander 474, which is configured to provide a plurality of inter-object-correlation values associated with a plurality of pairs of related audio objects on the basis of the common inter-object-correlation value. However, it should be noted that the single inter-object-correlation expander 474 may be arranged before the noiseless decoding 464 and the de-quantization 468 in some embodiments. For example, the single inter-object-correlation expander 474 may be integrated into a bitstream parser, which receives a bitstream comprising both the downmix signal representation 430 and the side information 432.

The SAOC decoder 420 also comprises an SAOC decoder processing and mixing 480, which is configured to receive the downmix signal representation 430 and the decoded parameters included (in an encoded form) in the side information 432. Thus, the SAOC decoder processing and mixing 480 may, for example, receive one or two inter-object-correlation values for every pair of (different) audio objects, wherein the one or two inter-object-correlation values may be zero for non-related audio objects and non-zero for related audio objects. In addition, the SAOC decoder processing and mixing 480 may receive object-level-difference values for every audio object. In addition, the SAOC decoder processing and mixing 480 may receive downmix-gain values and (optionally) downmix-channel-level-difference values describing the downmix performed in the SAOC downmix processing 440. Accordingly, the SAOC decoder processing and mixing 480 may provide a plurality of channel signals 484*a* to 484N in dependence on the downmix signal representation 430, the side information parameters included in the side information 432 and an interaction information 482, which describes a desired rendering of the audio objects. However, it should be noted that the channels 484*a* to 484N may be represented either in the form of individual audio channel signals or in the form of a parametric representation, like, for example, a multi-channel representation according to the MPEG Surround standard (comprising, for example, an MPEG Surround downmix signal and channel-related MPEG Surround side information). In other words, both an individual channel audio signal representation and a parametric multi-channel audio signal representation will be considered as an upmix signal representation within the present description.

In the following, some details regarding the functionality of the SAOC encoder 410 and of the SAOC decoder 420 will be described.

The SAOC side information, which will be discussed in the following, plays an important role in the SAOC encoding and the SAOC decoding. The SAOC side information describes the input objects (audio objects) by means of their time/frequency variant covariance matrix. The N object signals 420*a* to 420N (also sometimes briefly designated as "objects") can be written as rows in a matrix:

$$S = \begin{bmatrix} s_1(0) & s_1(1) & \dots & s_1(L-1) \\ s_2(0) & s_2(1) & \dots & s_2(L-1) \\ \vdots & \vdots & \ddots & \vdots \\ s_N(0) & s_N(1) & \dots & s_N(L-1) \end{bmatrix}$$

Here, the entries $s_i(1)$ designate spectral values of an audio object having audio object index for a plurality of temporal portions having time indices 1. A signal block of L samples represents the signal in a time and frequency interval which is a part of the perceptually motivated tiling of the time-frequency plane that is applied for the description of signal properties.

Hence, the covariance matrix is given as $$SS^* = \begin{bmatrix} \|s_1\|^2 & \rho_{12} & \dots & \rho_{1N} \\ \rho_{21} & \|s_2\|^2 & \dots & \rho_{2N} \\ \vdots & \vdots & \ddots & \vdots \\ \rho_{N1} & \rho_{N2} & \dots & \|s_N\|^2 \end{bmatrix}$$

with $$(\rho_{mn}=\rho_{nm}^*).$$

The covariance matrix is typically used by the SAOC decoder processing and mixing 480 in order to obtain the channel signals 484*a* to 484N.

The diagonal elements can directly be reconstructed at the SAOC decoder side with the OLD data, and the non-diagonal elements are given by the inter-object-correlations (IOCs) as $$\rho_{mn}=\|s_m\|\cdot\|s_n\|\cdot IOC_{mn}.$$

It should be noted that the object-level-difference values describe $s_m$ and $s_n$.

The number of inter-object-correlation values needed to convey the whole covariance matrix is N*N/2−N/2. As this number can get large (for example, for a large number N of object signals), resulting in a high bit demand, the SAOC encoder 410 (as well as the audio signal encoder 200) can, optionally, transmit only selected inter-object-correlation values for object pairs, which are signaled to be "related to" each other. This optional "related to" information is, for example, statically conveyed in an SAOC-specific configuration syntax element of the bitstream, which may, for example, be designated with "SAOCSpecificConfig( )". Objects, which are not related to each other, are, for example, assumed to be uncorrelated, i.e. their inter-object-correlation is equal to zero.

However, there exist application scenarios where all objects (or almost all objects) are related to each other. An example of such an application scenario is a telephone conference with a microphone setup and room acoustics with a high degree of inter-microphone cross talk. In these cases, the transmission of all IOC values would be needed (if the above-mentioned conventional mechanism was used), but usually would exceed the desired bit budget. As an alternative, assuming that all objects are uncorrelated would induce a large error in the model and, therefore, would yield sub-optimal audio quality of the rendered scene.

The underlying assumption of the proposed approach is that for certain SAOC application scenarios, uncorrelated sound sources result in correlated SAOC input objects due to the acoustic environment they are located in and due to the applied recording techniques.

Considering a telephone conference setup, for instance, the impact of the room reverberation and the imperfect isolation of the individual speakers leads to correlated SAOC objects although the talking of the individual subjects is uncorrelated. These acoustical circumstances and the resulting correlation can be approximately described with a single frequency- and time-varying value.

Thus, the proposed method successfully circumvents the high bitrate demand of conveying all desired object correlations. This is done by calculating a single time/frequency dependent single IOC value in a dedicated "single IOC calculator" module 448 in the SAOC encoder (see FIG. 4). Use of the "single IOC" feature is signaled in the SAOC information (for example, using the bitstream signaling parameter "bsOneIOC"). The single IOC value per time/frequency tile is then transmitted instead of all separate IOC values (for example, using the common inter-object-correlation bitstream parameter value).

In a typical application, the bitstream header (for example, the "SAOCSpecificConfig( )" element according to the non-prepublished SAOC Standard [SAOC]) includes one bit indicating if "single IOC" signaling or "normal" IOC signaling is used. Some details regarding this issue will be discussed below.

The payload frame data (for example, the "SAOCFrame( )" element in the non-prepublished SAOC Standard [SAOC]) then includes IOCs common for all objects or several IOCs depending on the "single IOCs" or "normal" mode.

Hence, a bitstream parser (which may be part of the SAOC decoder) for the payload data in the decoder could be designed according to the example below (which is formulated in a pseudo C code):

```
if (iocMode == SINGLE_IOC)
{
    readIocDataFromBitstream(1);
}
else
{
    readIocDataFromBitstream (numberOfTransmittedIocs);
}
```

According to the above example, the bitstream parser checks whether a flag "iocMode" (also designated with "bsOneIOC" in the following) indicates that there is only a single inter-object-correlation bitstream parameter value (which is signaled by the parameter value "SINGLE_IOC"). If the bitstream parser finds that there is only a single inter-object-correlation value, the bitstream parser reads one inter-object-correlation data unit (i.e., one inter-object-correlation bitstream parameter value) from the bitstream, which is indicated by the operation "readIocDataFromBitstream(1)". If, in contrast, the bitstream parser finds that the flag "iocMode" does not indicate the usage of a single (common) inter-object-correlation value, the bitstream parser reads a different number of inter-object-correlation data units (e.g., inter-object-correlation bitstream parameter values) from the bitstream, which is indicated by the function "readIocDataFromBitstream (numberOfTransmittedIocs)"). The number ("numberOfTransmittedIocs") of inter-object-correlation data units read in this case is typically determined by a number of pairs of related audio objects.

Alternatively, the "single IOC" signalling can be present in the payload frame (for example, in the so-called "SAOCFrame( )" element in the non-prepublished SAOC Standard) to enable dynamical switching between single IOC mode and normal IOC mode on a per-frame basis.

5. Encoder-Sided Implementation of the Calculation of a Common Inter-Object-Correlation Bitstream Parameter In the following, some implementations for the single IOC ($IOC_{single}$) calculation will be described.

5.1. Calculation Using Cross-Power Terms

In an embodiment of the SAOC encoder 410, the common inter-object-correlation bitstream parameter value $IOC_{single}$ can be computed according to the following equation:

$$IOC_{single} = \mathrm{Re}\left\{\frac{\sum_{i=1}^{N}\sum_{j=i+1}^{N} nrg_{ij}}{\sum_{i=1}^{N}\sum_{j=i+1}^{N}\sqrt{nrg_{ii}nrg_{jj}}}\right\}$$

with the cross power terms $$nrg_{ij} = \sum_n \sum_k s_i^{n,k} (s_j^{n,k})^*$$

where n and k are the time and frequency instances (or time and frequency indices) for which the SAOC parameter applies.

In other words, the common inter-object-correlation bitstream parameter value $IOC_{single}$ can be computed in dependence on a ratio between a sum of cross-power terms $nrg_{ij}$ (wherein the object index i is typically different from the object index j) and a sum of average energy values $\sqrt{nrg_{ii} nrg_{jj}}$ (which average energy values represent, for example, a geometrical mean between the energy values $nrg_{ii}$ and $nrg_{jj}$).

The summation may be performed, for example, for all pairs of different audio objects, or for pairs of related audio objects only.

The cross-power term $nrg_{ij}$ may, for example, be formed as a sum over complex conjugate products (with one of the factors being complex-conjugated) of spectral coefficients $s_i^{n,k}$, $s_j^{n,k}$ associated with the audio object signals of the pair of audio objects under consideration for a plurality of time instances (having time indices n) and/or a plurality of frequency instances (having frequency indices k).

A real part of said ratio may be formed (for example, by an operation Re{ }) in order to have a real-valued common inter-object-correlation bitstream parameter value $IOC_{single}$, as shown in the above equation.

5.2. Usage of a Constant Value

In another embodiment, a constant value c may be chosen to obtain the common inter-object-correlation bitstream parameter value $IOC_{single}$ in accordance with $$IOC_{single} = c,$$

with c being a constant.

This constant c could, for example, describe a time- and frequency-independent cross talk of a room with specific acoustics (amount of reverb) where a telephone conference takes place.

The constant c may, for example, be set in accordance with an estimation of the room acoustics, which may be performed by the SAOC encoder. Alternatively, the constant c may be input via a user interface, or may be predetermined in the SAOC encoder 410.

6. Decoder-Sided Determination of the Inter-Object-Correlation Values for all Object Pairs In the following, it will be described how the inter-object-correlation values for all object pairs can be obtained.

At the decoder side (for example, in the SAOC decoder 420), the single inter-object-correlation (bitstream) parameter ($IOC_{single}$) is used to determine the inter-object-correlation values for all object pairs. This is done, for example, in the "Single IOC Expander" module 474 (see FIG. 4).

An advantageous method is a simple copy operation. The copying can be applied with or without considering the "related to" information conveyed, for example, in the SAOC bitstream header (for example, in the portion "SAOCSpecificConfiguration( )").

In an embodiment, a copying without "related to" information (i.e., without transferring or considering a "related to" information) may be performed in the following manner:

$$IOC_{mn} = IOC_{single}, \text{ for all } m, n \text{ with } m \neq n.$$

Thus, all inter-object-correlation values for pairs of different audio objects are set to the common inter-object-correlation (bitstream) parameter value.

In another embodiment, a copying with "related to" information (i.e., taking into consideration the "related to" information) is performed, for example, in the following manner:

$$IOC_{mn} = \begin{cases} IOC_{single} & \text{, for all } m, n \text{ with } m \neq n \text{ and } relatedTo(m, n) = 1 \\ 0 & \text{, for all } m, n \text{ with } m \neq n \text{ and } relatedTo(m, n) = 0 \end{cases}$$

Accordingly, one or even two inter-object-correlation values associated with a pair of audio objects (having audio object indices m and n) are set to the value $IOC_{single}$ specified, for example, by the common inter-object-correlation bitstream parameter value, if the object relationship information "relatedTo(m,n)" indicates that said audio objects are related to each other. Otherwise, i.e. if the object relationship information "relatedTo(m,n)" indicates that the audio objects of a pair of audio objects are not related, one or even two inter-object-correlation values associated with the pair of audio objects are set to a predetermined value, for example, to zero.

However, different distribution methods are possible, for example, taking the object powers into account. For example, inter-object-correlation values relating to objects with relatively low power could be set to high values, such as 1 (full correlation), to minimize the influence of the decorrelation filter in the SAOC decoder.

7. Decoder Concept Using Bitstream Elements According to FIGS. 5 and 6

In the following, a decoder concept of an audio signal decoder using the bitstream syntax elements according to FIGS. 5 and 6 will be described. It should be noted here that the bitstream syntax and bitstream evaluation concept, which will be described with reference to FIGS. 5 and 6, can be applied, for example, in the audio signal decoder 100 according to FIG. 1 and in the audio signal decoder 420 according to FIG. 4. In addition, it should be noted that the audio signal encoder 200 according to FIG. 2 and the audio signal decoder 410 according to FIG. 4 can be adapted to provide bitstream syntax elements as discussed with respect to FIGS. 5 and 6.

Accordingly, the bitstream comprising the downmix signal representation 110 and the object-related parametric information 112 and/or the bitstream representation 220 and/or the bitstream 300 and/or a bitstream comprising the downmix information 430 and the side information 432, may be provided in accordance with the following description.

An SAOC bitstream, which may be provided by the above-described SAOC encoders and which may be evaluated by the above-described SAOC decoders may comprise an SAOC specific configuration portion, which will be described in the following taking reference to FIG. 5, which shows a syntax representation of such an SAOC specific configuration portion "SAOCSpecificConfig( )".

The SAOC specific configuration information comprises, for example, sampling frequency configuration information, which describes a sampling frequency used by an audio signal encoder and/or to be used by an audio signal decoder. The SAOC specific configuration information also comprises a low delay mode configuration information, which describes whether a low delay mode has been used by an audio signal encoder an/or should be used by an audio signal decoder. The SAOC specific configuration information also comprises a frequency resolution configuration information, which describes a frequency resolution used by an audio signal encoder and/or to be used by an audio signal decoder. The SAOC specific configuration information also comprises a frame length configuration information describing a frame length of audio frames used by the SAOC encoder and/or to be used by the SAOC decoder. The SOAC specific configuration information also comprises an object number configuration information which describes a number of audio objects. This object number configuration information, which is also designated with "bsNumObjects", for example describes the value N, which has been used above.

The SAOC specific configuration information also comprises an object relationship configuration information. For example, there may be one bitstream bit for every pair of different audio objects. However, the relationship of audio objects may be represented, for example, by a square N×N matrix having a one-bit entry for every combination of audio objects. Entries of said matrix describing the relationship of an object with itself, i.e., diagonal elements, may be set to one, which indicates that an object is related to itself. Two entries, namely a first entry having a first index i and a second index j, and a second entry having a first index j and a second index i, may be associated with each pair of different audio objects having audio object indices i and j. Accordingly, a single bitstream bit determines the values of two entries of the object relationship matrix, which are set to identical values.

As can be seen, a first audio object index i runs from i=0 to i=bsNumObjects (outer for-loop). A diagonal entry "bsRelatedTo[i][i]" is set to one for all values of i. For a first audio object index i, bits describing a relationship between audio object i and audio objects j (having audio object index j) are included in the bit stream for j=i+1 to j=bsNumObjects. Accordingly, entries of the relationship matrix "bsRelatedTo[i][j]", which describe a relationship between the audio objects having audio object indices i and j, are set to the value given in the bit stream. In addition, an object relationship matrix entry "bsRelatedTo[j][i]" is set to the same value, i.e., to the value of the matrix entry "bsRelatedTo[i][j]". For details, reference is made to the syntax representation of FIG. 5.

The SAOC specific configuration information also comprises an absolute energy transmission configuration information, which describes whether an audio encoder has included an absolute energy information into the bit stream, and/or whether an audio decoder should evaluate an absolute energy transmission configuration information included in the bit stream.

The SAOC specific configuration information also comprises a downmix-channel-number configuration information, which describes a number of downmix channels used by the audio encoder and/or to be used by the audio decoder. The SAOC specific configuration information may also comprise additional configuration information, which is not relevant for the present application, and which can optionally be omitted.

The SAOC specific configuration information also comprises a common inter-object-correlation configuration information (also designated as a "bitstream signaling parameter" herein) which describes whether a common inter-object-correlation bitstream parameter value is included in the SAOC bitstream, or whether object-pair-individual inter-object-correlation bitstream parameter values are included in the SAOC bitstream. Said common inter-object-correlation configuration information may, for example, be designated with "bsOneIOC, and may be a one-bit value.

The SAOC specific configuration information may also comprise a distortion control unit configuration information.

In addition, the SAOC specific configuration information may comprise one or more fill bits, which are designated with "ByteAlign( )", and which may be used to adjust the lengths of the SAOC specific configuration information. In addition, the SAOC specific configuration information may comprise optional additional configuration information "SAOCExtensionConfig( )" which is not of relevance for the present application and which will not be discussed here for this reason.

It should be noted here that the SAOC specific configuration information may comprise more or less than the above described configuration information. In other words, some of the above described configuration information may be omitted in some embodiments, and additional configuration information may also be also included in some embodiments.

However, it should be noted that the SAOC specific configuration information may, for example, be included once per piece of audio in an SAOC bitstream. However, the SAOC specific configuration information may optionally be included more often in the bitstream. Nevertheless, the SAOC specific configuration information is typically provided for a plurality of SAOC frames, because the SAOC specific configuration information provides a significant bit load overhead.

In the following, the syntax of an SAOC frame will be described taking reference to FIG. 6, which shows a syntax representation of such an SAOC frame. The SAOC frame comprises encoded object-level-difference values OLD, which may be included band-wise and per audio object.

The SAOC frame also comprises encoded absolute energy values NRG, which may be considered as optional, and which may be included band-wise.

The SAOC frame also comprises encoded inter-object-correlation values IOC, which may be provide band-wise, i.e., separately for a plurality of frequency bands, and for a plurality of combinations of audio objects.

In the following, the bitstream will be described with respect to the operations which may be performed by a bitstream parser parsing the bitstream.

The bitstream parser may, for example, initialize variables k, iocldx1, iocldx2 to a value of zero in a first preparatory step.

Subsequently, the bitstream parser may perform a parsing for a plurality of values of the first audio object index i between i=0 and i=bsNumObjects (outer for-loop). The bitstream parser may, for example, set an inter-object-correlation index value idxIoc[i][i] describing a relationship between the audio object having audio object index i and itself to zero which indicates a full correlation.

Subsequently, a bitstream parser may evaluate the bitstream for values j of a second audio object index between i+1 and bsNumObjects. If audio objects having audio object indices and j are related, which is indicated by a non-zero value of the object relationship matrix entry "bsRelatedTo [i][j]", the bitstream parser performs an algorithm 610, and otherwise, the bitstream parser sets the inter-object-correlation index associated with the audio objects having audio object indices i and j to five (operation "idxIOC[i][j]=5"), which describes a zero correlation. Thus, for pairs of audio objects, for which the object relationship matrix indicates no relationship, the inter-object-correlation value is set to zero. For related pairs of audio objects, however, the bitstream signaling parameter "bsOneIOC", which is included in the SAOC specific configuration, is evaluated to decide how to proceed. If the bitstream signaling parameter "bsOneIOC" indicates that there are object-pair-individual inter-object-correlation bitstream parameter values, a plurality of inter-object-relationship indices idxIOC[i][j] (which may be considered as inter-object-relationship bitstream parameter values) are extracted from the bitstream for "numBands" frequency bands using the function "EcDataSaoc", wherein said function may be used to decode the inter-object-relationship indices.

However, if the bitstream signaling parameter "bsOneIOC" indicated that a common inter-object-correlation bitstream parameter value is used for a plurality of pairs of audio objects, and id the bitstream parameter "bsRelatedTo [i][j]" indicates that the audio objects having audio object indices i and j are related, a single set of a plurality of inter-object-correlation indices "idxIOC[i][j]" is read from the bitstream using the function "EcDataSaoc" for a plurality of numBands frequency bands, wherein only a single inter-object-correlation index is read for any given frequency band. However upon re-execution of the algorithm 610, a previously read inter-object-correlation index idxIOC [iocldx1][iocldx2] is copied without evaluating the bitstream. This is ensured by use of the variable k, which is initialized to zero and incremented upon evaluation of the first set of inter-object-correlation indices idxIOC[i][ ].

To summarize, for each combination of two audio objects, it is first evaluated whether the two audio objects of such a combination are signaled as being related to each other (for example, by checking whether the value "bsRelatedTo[i][j]" takes the value zero or not). If the audio objects of the pair of audio objects are related, the further processing 610 is performed. Otherwise, the value "idxIOC[i][j]" associated to this pair of (substantially unrelated) audio objects is set to a predetermined value, for example, to a predetermined value indicating a zero inter-object-correlation.

In the processing 610, a bitstream value is read from the bitstream for every pair of audio objects (which is signaled to comprise related audio objects) if the signaling "bsOneIOC" is inactive. Otherwise, i.e., if the signaling "bsOneIOC" is active, only one bitstream value is read for one pair of audio objects, and the reference to said single pair is maintained by setting the index values iocldx1 and iocldx2 to point at this read out value. The single read out value is reused for other pairs of audio objects (which are signaled as being related to each other) if the signaling "bsOneIOC" is active.

Finally, it is also ensured that a same inter-object-correlation index value is associated to both combinations of two given different audio objects, irrespective of which of the two given audio objects is the first audio object and which of the two given audio objects is the second audio object.

In addition, it should be noted that the SAOC frame typically comprises the encoded downmix gain values (DMG) on a per-audio-object basis.

In addition, the SAOC frame typically comprises encoded downmix-channel-level-differences (DCLD), which may optionally be included on a per-audio-object basis.

The SAOC frame further optionally comprises encoded post-processing-downmix-gain values (PDG), which may be included in a band wise-manner and per downmix channel.

In addition, the SAOC frame may comprise encoded distortion-control-unit parameters, which determine the application of distortion control measures.

Moreover, the SAOC frame may comprise one or more fill bits "ByteAlign( )".

Furthermore, an SAOC frame may comprise extension data "SAOCExtensionFrame( )", which, however, are not relevant for the present application and will not be discussed in detail here for this reason.

Taking reference now to FIG. 7, an example for an advantageous quantization of the inter-object-correlation parameter will be described.

Figures 7, 8:
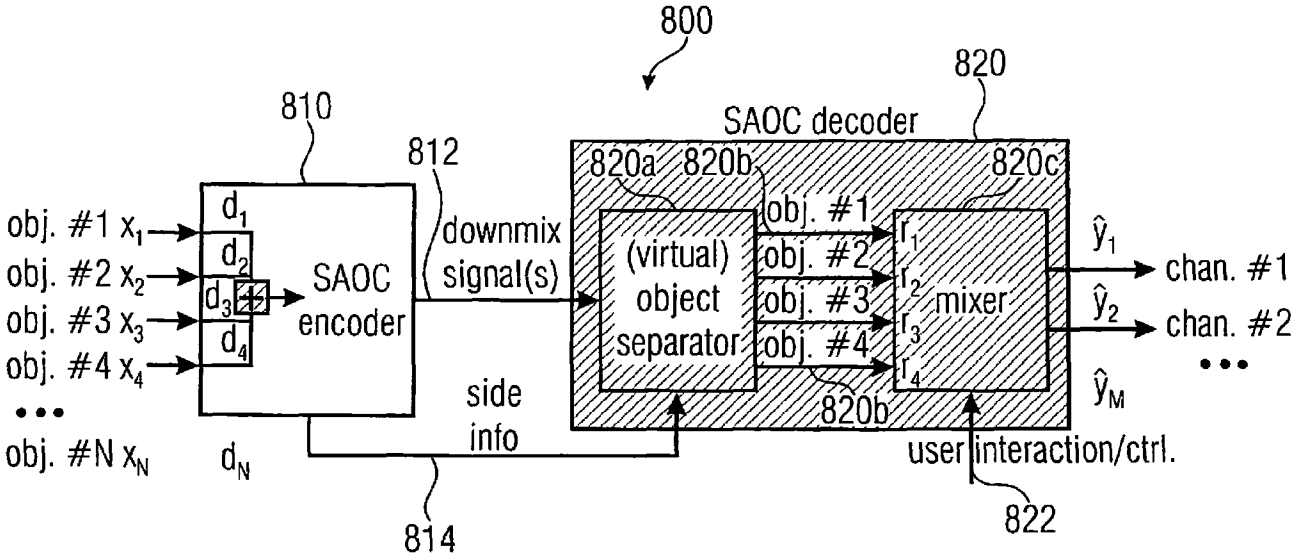
FIG. 7 shows a table representing a parameter quantization of the inter-object-correlation parameter.
FIG. 8 shows a block schematic diagram of a reference MPEG SAOC system.
Figure 9A:
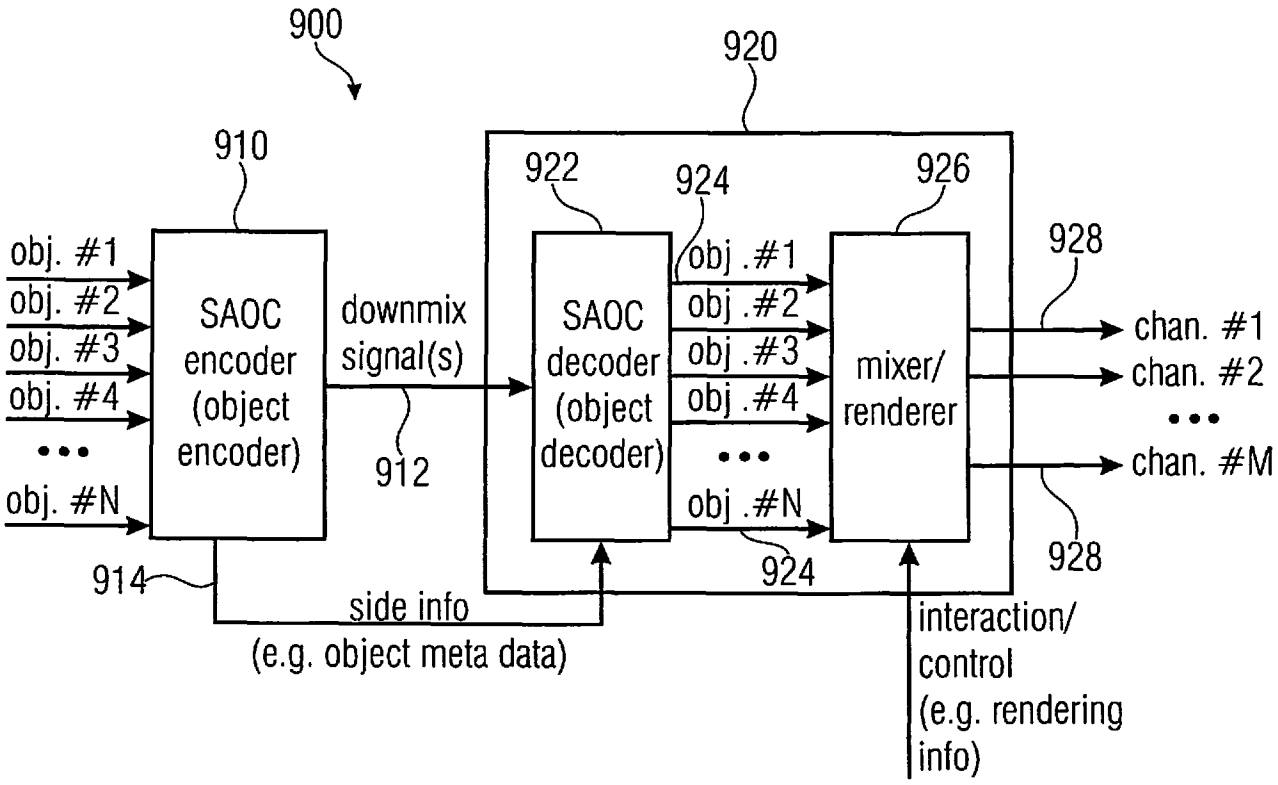
FIG. 9*a* shows a block schematic diagram of a reference SAOC system using a separate decoder and mixer.
Figure 9B:
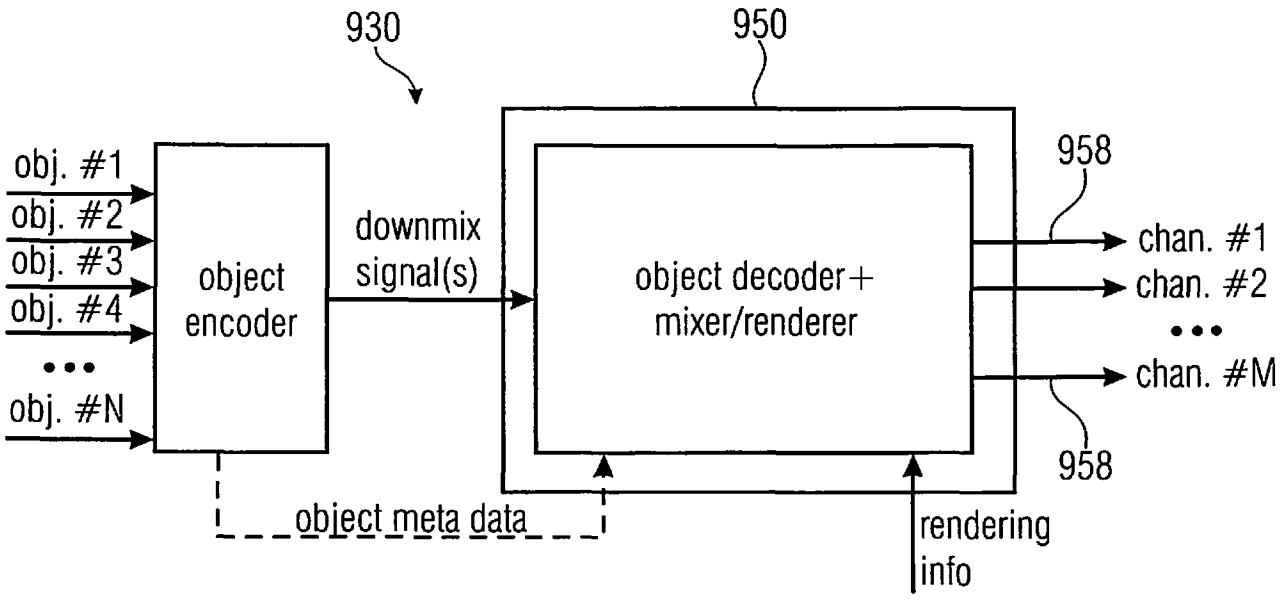
FIG. 9*b* shows a block schematic diagram of a reference SAOC system using an integrated decoder and mixer.
Figure 9C:
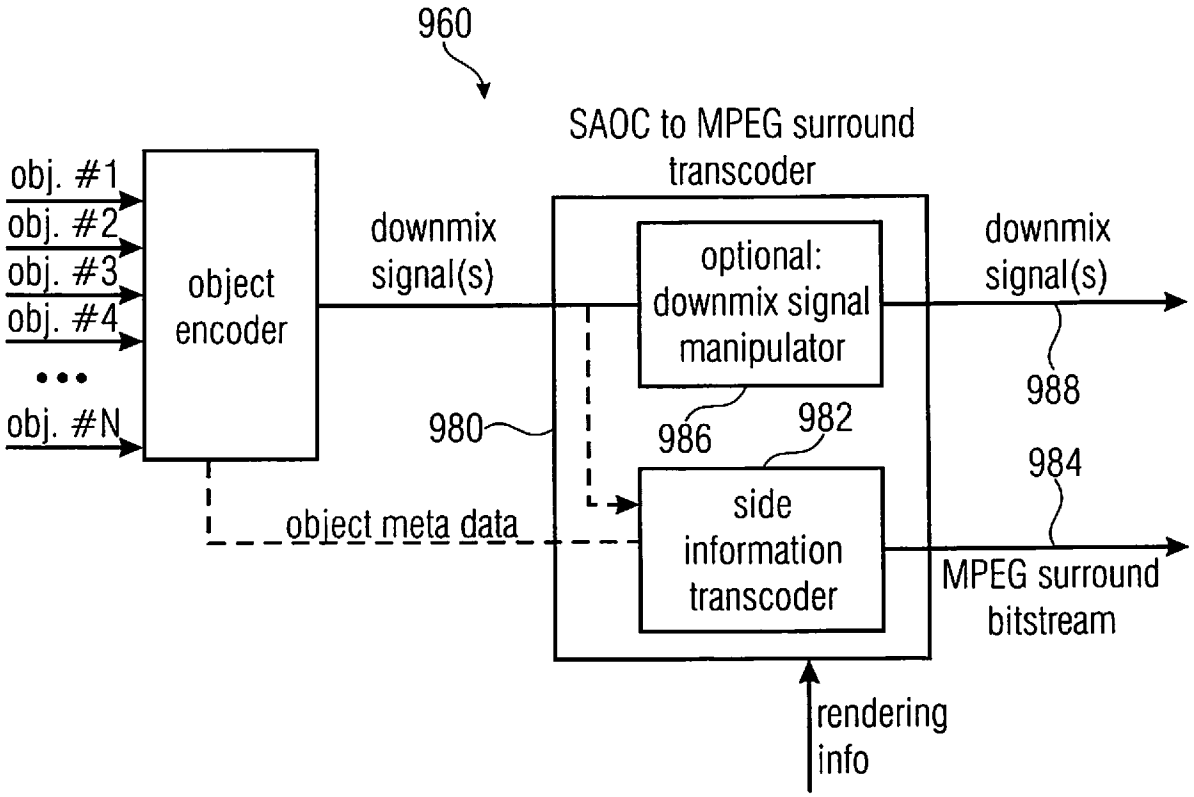
FIG. 9*c* shows a block schematic diagram of a reference SAOC system using an SAOC-to-MPEG transcoder.

As can be seen, a first row 710 of a table of FIG. 7 describes the quantization index idx, which is in a range between zero and seven. This quantization index may be allocated to the variable "idxIOC[i][j]". A second row 720 of the table of FIG. 7 shows the associated inter object correlation value, and are in a range between −0.99 and 1. Accordingly, the values of the parameters "idxIOC[i][j]" may be mapped onto inversely quantized inter-object-correlation values using the mapping of the table of FIG. 7.

To conclude, an SAOC configuration portion "SAOCSpecificConfig( )" advantageously comprises a bitstream parameter "bsOneIOC" which indicates if only a single IOC parameter is conveyed common to all objects which have relation with each other, signaled by "bsRelatedTo[i][j]=1". The inter-object-correlation values are included in the bitstream in encoded form "EcDataSaoc (IOC,k,numBands)". An array "idxIOC[i][j]" is filled on the basis of one or more encoded inter-object-correlation values. The entries of the array "idxIOC[i][j]" are mapped onto inversely quantized values using the mapping table of FIG. 7, to obtain inversely quantized inter-object-correlation values. The inversely quantized inter-object-correlation values, which are designated with $IOC_{i,j}$, are used to obtain entries of a covariance matrix. For this purpose, inversely quantized object-level-difference parameters are also applied, which are designated with $OLD_i$.

The covariance matrix E of size N×N with elements $e_{i,j}$ represents an approximation of the original signal covariance matrix E≈SS* and is obtained from the OLD and IOC parameters as $$e^{i,j}=\sqrt{OLD_i OLD_j}\,IOC_{i,j}.$$

7. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as tall within the true spirit and scope of the present invention.

8. References

[BCC] C. Faller and F. Baumgarte, "Binaural Cue Coding—Part II: Schemes and applications," IEEE Trans. on Speech and Audio Proc., vol. 11, no. 6, November 2003

[JSC] C. Faller, "Parametric Joint-Coding Audio Sources", 120th AES Convention, Paris, 2006, Preprint 6752

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April 2007

[SAOC2] J. Engdegård, B. Resch, C. Falch, O. Hellmuth, J. Hilpert, A. Hölzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008, Preprint 7377

[SAOC] ISO/IEC, "MPEG audio technologies—Part 2: Spatial Audio Object Coding (SAOC)," ISO/IEC JTC1/SC29/WG11 (MPEG) FCD 23003-2.

The invention claimed is:

1. An audio signal decoder for providing an upmix signal representation based on a downmix signal representation and an object-related parametric information, and depending on a rendering information, the audio signal decoder comprising:

an object parameter determinator configured to acquire inter-object-correlation values for a plurality of pairs of audio objects, wherein the object parameter determinator is configured to evaluate a bitstream signaling parameter in order to decide whether to evaluate individual inter-object-correlation bitstream parameter values, to acquire inter-object-correlation values for a plurality of pairs of related audio objects, or to acquire inter-object-correlation values for the plurality of pairs of related audio objects using a common inter-object-correlation bitstream parameter value; and a signal processor configured to acquire the upmix signal representation based on the downmix signal representation and using the inter-object-correlation values for the plurality of pairs of related audio objects and the rendering information;

wherein the object-related parametric information comprises the bitstream signaling parameter and the individual inter-object-correlation bitstream parameter values or the common inter-object-correlation bitstream parameter value;

wherein the object parameter determinator is configured to evaluate an object-relationship-information, describing whether two audio objects are related to each other; and wherein the object parameter determinator is configured to selectively acquire inter-object-correlation values for pairs of audio objects, for which the object-relationship-information indicates a relationship, using the common inter-object-correlation bitstream parameter value and to set inter-object-correlation values for pairs of audio objects, for which the object-relationship information indicates no relationship, to a predefined value.

2. The audio decoder according to claim 1, wherein the object parameter determinator is configured to evaluate the object-relationship information comprising a one-bit flag for each combination of different audio objects, wherein the one-bit flag associated to a given combination of different audio objects indicates whether the audio objects of the given combination are related or not.

3. The audio decoder according to claim 1, wherein the object parameter determinator is configured to set the inter-object-correlation value for all pairs of different related audio objects to a common value defined by the common inter-object-correlation bitstream parameter value, or to a value derived from the common value defined by the common inter-object-correlation bitstream parameter value.

4. The audio decoder according to claim 1, wherein the object parameter determinator comprises a bitstream parser configured to parse a bitstream representation of an audio content, to acquire the bitstream signaling parameter and the individual inter-object-correlation bitstream parameter values or the common inter-object-correlation bitstream parameter value.

5. The audio decoder according to claim 1, wherein the audio signal decoder is configured to combine an inter-object-correlation value $IOC_{i,j}$ associated with a pair of related audio objects with an object level difference value $OLD_i$ describing an object level of a first audio object of the pair of related audio objects and with an object level difference value $OLD_j$ describing an object level of a second audio object of the pair of related audio objects, to acquire a covariance value $e_{i,j}$ associated with the pair of related audio objects;

wherein the audio decoder is configured to acquire an element $e_{i,j}$ of a covariance matrix according to $e_{i,j}=\sqrt{OLD_i OLD_j}IOC_{i,j}$.

6. The audio signal decoder according to claim 1, wherein the audio signal decoder is configured to handle three or more audio objects; and wherein the object parameter determinator is configured to provide an inter-object-correlation value for every pair of different audio objects.

7. The audio signal decoder according to claim 1, wherein the object parameter determinator is configured to evaluate the bitstream signaling parameter, which is comprised in a configuration bitstream portion, in order to decide whether to evaluate the individual inter-object-correlation bitstream parameter values to acquire the inter-object-correlation values for a plurality of pairs of related audio objects, or to acquire the inter-object-correlation values for a plurality of pairs of related audio objects using the common inter-object-correlation bitstream parameter value; and wherein the object parameter determinator is configured to evaluate an object relationship information, which is comprised in the configuration bitstream portion, to determine whether two audio objects are related; and wherein the object parameter determinator is configured to evaluate a common inter-object-correlation bitstream parameter value, which is comprised in a frame data bitstream portion for every frame of the audio content, if it is decided to acquire inter-object-correlation values for a plurality of pairs of related audio objects using a common inter-object-correlation bitstream parameter value.

8. A method for providing an upmix signal representation based on a downmix signal representation and an object-related parametric information and in dependence on a rendering information, the method comprising:

acquiring inter-object-correlation values for a plurality of pairs of audio objects, wherein a bitstream signaling parameter is evaluated in order to decide whether to evaluate individual inter-object-correlation bitstream parameter values, to acquire inter-object-correlation values for a plurality of pairs of related audio objects, or to acquire inter-object-correlation values for the plurality of pairs of related audio objects using a common inter-object-correlation bitstream parameter value; and acquiring the upmix signal representation based on the downmix signal representation and using the inter-object-correlation values for the plurality of pairs of related audio objects and the rendering information;

wherein an object-relationship information, describing whether two audio objects are related to each other, is evaluated, and wherein the inter-object-correlation values are selectively acquired for pairs of audio objects, for which the object relationship-information indicates a relationship, using the common inter-object-correlation bitstream parameter value, and wherein the inter-object-correlation values are set to a predefined value for pairs of audio objects, for which the object-relationship information indicates no relationship; and wherein the object-related parametric information comprises the bitstream signaling parameter and the individual inter-object-correlation bitstream parameter values or the common inter-object-correlation bitstream parameter value;

wherein the method is performed using a hardware apparatus, or using a computer, or using a combination of a hardware apparatus and a computer.

9. A non-transitory storage medium having stored thereon a computer program for performing the method for providing an upmix signal representation based on a downmix signal representation and an object-related parametric information and in dependence on a rendering information, the method comprising:

acquiring inter-object-correlation values for a plurality of pairs of audio objects, wherein a bitstream signaling parameter is evaluated in order to decide whether to evaluate individual inter-object-correlation bitstream parameter values, to acquire inter-object-correlation values for a plurality of pairs of related audio objects, or to acquire inter-object-correlation values for the plurality of pairs of related audio objects using a common inter-object-correlation bitstream parameter value; and acquiring the upmix signal representation based on the downmix signal representation and using the inter-object-correlation values for the plurality of pairs of related audio objects and the rendering information;

wherein an object-relationship information, describing whether two audio objects are related to each other, is evaluated, and wherein the inter-object-correlation values are selectively acquired for pairs of audio objects, for which the object relationship-information indicates a relationship, using the common inter-object-correlation bitstream parameter value, and wherein the inter-object-correlation values are set to a predefined value for pairs of audio objects, for which the object-relationship information indicates no relationship; and wherein the object-related parametric information comprises the bitstream signaling parameter and the individual inter-object-correlation bitstream parameter values or the common inter-object-correlation bitstream parameter value, when the computer program runs on a computer.

* * * * *